US005447027A

United States Patent [19]

Ishikawa et al.

[11] Patent Number: 5,447,027

[45] Date of Patent: Sep. 5, 1995

[54] HYDRAULIC DRIVE SYSTEM FOR HYDRAULIC WORKING MACHINES

[75] Inventors: Koji Ishikawa, Ibaraki; Toichi Hirata, Ushiku; Genroku Sugiyama, Ibaraki, all of Japan

[73] Assignee: Hitachi Construction Machinery Co., Ltd., Tokyo, Japan

[21] Appl. No.: 302,786

[22] PCT Filed: Mar. 23, 1994

[86] PCT No.: PCT/JP94/00464

§ 371 Date: Sep. 12, 1994

§ 102(e) Date: Sep. 12, 1994

[87] PCT Pub. No.: WO94/21925

PCT Pub. Date: Sep. 29, 1994

[30] Foreign Application Priority Data

Mar. 23, 1993 [JP] Japan ..... 5-063944

[51] Int. Cl.[6] ..... F16D 31/02

[52] U.S. Cl. ..... 60/420; 60/444; 60/452; 60/494

[58] Field of Search ..... 60/420, 426, 468, 494, 60/444, 445, 452, 450

[56] References Cited

U.S. PATENT DOCUMENTS

| | | | |
|---|---|---|---|
| 4,528,813 | 7/1985 | Izumi et al. | 60/444 X |
| 4,967,557 | 11/1990 | Izumi et al. | 60/452 X |
| 5,046,309 | 9/1991 | Yoshino | 60/452 X |
| 5,251,440 | 10/1993 | Bong-Dong et al. | 60/445 X |
| 5,295,795 | 3/1994 | Yasuda et al. | 60/445 X |

FOREIGN PATENT DOCUMENTS

| | | |
|---|---|---|
| 47-3927 | 2/1972 | Japan . |
| 50-5354 | 3/1975 | Japan . |
| 63-88303 | 4/1988 | Japan . |
| WO94/04828 | 3/1994 | WIPO . |

*Primary Examiner*—Edward K. Look
*Assistant Examiner*—Hoang Nguyen
*Attorney, Agent, or Firm*—Fay, Sharpe, Beall, Fagan, Minnich & McKee

[57] ABSTRACT

A hydraulic drive system comprises a controller (12) and several condition sensors. A boom-up target flow rate setting section determines a boom-up target flow rate based on signals from a pressure sensor (11) and a rotational speed meter (16), a pump delivery rate detecting section determines a pump delivery rate based on signals from a tilt angle sensor (15) and the rotational speed meter (16), a differential pressure detecting section and a center bypass flow rate calculating section determine a center bypass flow rate based on signals from pressure sensors (9, 10), a boom cylinder calculating section determines a boom cylinder flow rate from the pump delivery rate and the center bypass flow rate, and a first pump target displacement volume calculating section calculates a first pump target tilt angle $\theta_1$ in accordance with the difference between the boom-up target flow rate and the boom cylinder flow rate. In this case, $\theta_1$ is larger than a second pump target tilt angle $\theta_2$ for negative control and is selected by a maximum value selecting section. Then, a minimum value selecting section selects the smaller one of $\theta_1$ and a maximum tilt angle $\theta_{max}$ determined with horsepower control, and drive signal generating section outputs a corresponding target current to a solenoid proportional valve (13) for driving a piston (6a) of a regulator (6) to the right in FIG. 4.

12 Claims, 18 Drawing Sheets

FIG.8

| BOOM-UP | BOOM-DOWN | ARM-DUMP | ARM-CROWD |
|---|---|---|---|
| ◎ | × | ◎ | × |

◎: CONTROL BASED ON ACTUATOR FLOW RATE IS PERFORMED

×: NEGATIVE CONTROL IS PERFORMED

FIG.12

| | ARM−DUMP | ARM−CROWD |
|---|---|---|
| BOOM−UP | ◎ | ● |
| BOOM−DOWN | ● | × |

◎ :CONTROL BASED ON TOTAL ACTUATOR FLOW RATE IS PERFORMED

● :CONTROL BASED ON TOTAL ACTUATOR FLOE RATE OR NEGATIVE CONTROL IS SELECTED DEPENDING ON MAGNITUDE OF LOAD,ETC.

× :NEGATIVE CONTROL IS PERFORMED

FIG. 14

| | ARM−DUMP | ARM−CROWD |
|---|---|---|
| BOOM−UP | ○ | ⊖ |
| BOOM−DOWN | ⦶ | × |

○ :CONTROL BASED ON BOOM CYLINDER FLOW RATE OR POSITIVE CONTROL IS SELECTED WITH SETTING OF GAIN FUNCTION,ETC

⊖ :CONTROL BASED ON BOOM CYLINDER FLOW RATE OR NEGATIVE CONTROL IS SELECTED DEPENDING ON MAGNITUDE OF BOOM CYLINDER LOAD,ETC

⦶ :POSITIVE OR NEGATIVE CONTROL IS SELECTED DEPENDING ON TIME AT WHICH ARM IS OPERATED,ETC

× :NEGATIVE CONTROL IS PERFORMED

HYDRAULIC DRIVE SYSTEM FOR HYDRAULIC WORKING MACHINES

TECHNICAL FIELD

The present invention relates to a hydraulic drive system for hydraulic working machines such as hydraulic excavators, and more particularly to a hydraulic drive system for hydraulic working machines which has a directional control valve of center bypass type.

BACKGROUND ART

Conventionally known hydraulic drive systems of the above-described type are described in, for example, JP, B, 47-3927 and JP, B, 50-5354. Each of these known hydraulic drive systems comprises a variable displacement hydraulic pump, at least one actuator driven by a hydraulic fluid delivered from the hydraulic pump, a directional control valve of center bypass type having a meter-in passage provided with a meter-in variable restrictor and a center bypass passage provided with a bleed-off variable restrictor for controlling a flow of the hydraulic fluid supplied from the hydraulic pump to the actuator, a low pressure circuit, a center bypass line for connecting the center bypass passage to the low pressure circuit at a point downstream of the bleed-off variable restrictor, a pressure generator, e.g., a fixed restrictor, disposed in the center bypass line, and a pump regulator for controlling a displacement volume of the hydraulic pump using the pressure generated by the fixed restrictor as a control pressure.

The pump regulator performs well-known negative control based on the control pressure generated by the fixed restrictor. More specifically, the pump regulator controls a displacement volume of the hydraulic pump so that the displacement volume increases as the control pressure is lowered, and it decreases as the control pressure is raised.

In the prior art arranged as above, when the directional control valve is gradually shifted from a neutral position through its stroke with the intention of driving the actuator, an opening area of the bleed-off variable restrictor of the directional control valve is gradually reduced and, to the contrary, an opening area of the meter-in variable restrictor thereof is gradually increased.

When the directional control valve is in the neutral position or at the start point of the stroke thereof, i.e., when the bleed-off variable restrictor begins to close, the control pressure generated by the fixed restrictor is high and the hydraulic pump is kept at a predetermined small displacement volume to deliver the hydraulic fluid at a standby flow rate which is small corresponding to the predetermined small displacement volume. Then, as the bleed-off variable restrictor is gradually closed, a pressure of the hydraulic fluid delivered from the hydraulic pump, i.e., a pump pressure, is raised. Assuming now that a load pressure of the actuator is Pa, the actuator starts moving at the time the pump pressure is raised in excess of Pa. As the actuator starts moving and the hydraulic pump starts supplying the hydraulic fluid to the actuator, a flow rate of the hydraulic fluid passing through the center bypass passage is reduced accordingly. Such a reduction in the flow rate passing through the center bypass passage lowers the control pressure generated by the fixed restrictor in the center bypass line. Correspondingly, the pump regulator is driven so as to increase the displacement volume of the hydraulic pump. As a result, a delivery rate of the hydraulic pump is gradually increased to provide a predetermined flow rate characteristic, i.e., metering characteristic.

DISCLOSURE OF THE INVENTION

In the prior art described above, when the load pressure of the actuator is a relatively small pressure P2, the delivery rate of the hydraulic pump is relatively moderately increased with an increase in the spool stroke of the directional control valve, and the flow rate of the hydraulic fluid supplied to the actuator is relatively moderately increased corresponding to such an increase in the spool stroke, thereby providing a good metering characteristic.

However, when the load pressure of the actuator is a pressure P1 greater than P2, the actuator will not start moving until the bleed-off variable restrictor is closed to such an extent that the pump pressure is raised in excess of P1. At the pump pressure not higher than P1, therefore, the flow rate passing through the center bypass passage is not reduced and hence the delivery rate of the pump is not increased. When the bleed-off variable restrictor is closed to such an extent that the pump pressure exceeds P1, the flow rate passing through the center bypass passage is reduced and the delivery rate of the pump is abruptly increased. Correspondingly, the flow rate supplied to the actuator is abruptly increased, which greatly deteriorates the metering characteristic.

Taking a hydraulic excavator as an example, the above deterioration of the metering characteristic becomes more remarkable, especially when the actuator is an arm cylinder for driving an arm or a boom cylinder for driving a boom. For example, when the load is light with a bucket kept empty, a load pressure of the arm cylinder or the boom cylinder is so small that the arm or the boom can be operated in a sufficiently satisfactory manner. In the work of suspending a heavy burden such as an earthen pipe, however, the load pressure is so increased that the arm or the boom is not moved with slight manipulation of a control lever for shifting an arm directional control valve or a boom directional control valve, and it starts moving only after the control lever comes close to a stroke end. Then, an operating speed of the arm or the boom is quickly increased upon the control lever being operated just a little under the above condition. Accordingly, an operator has to perform the work while paying considerable care, resulting in that an improvement of operating efficiency is not expected and the operator feel much fatigued.

To solve the above-mentioned problem, the applicant has proposed, in PCT/JP93/01188 (international filing date: Aug. 25, 1993) and WO 94/04828 (date of international publication: Mar. 3, 1994), a hydraulic drive system for hydraulic working machines comprising first signal generating section means for generating a first control signal, which determines a first target displacement volume of a hydraulic pump, using a pressure generated by a pressure generator disposed in a center bypass line, second signal generating section means for generating a second control signal which determines a second target displacement volume of the hydraulic pump, selecting section means for applying one of the first control signal and the second control signal which provides a larger target displacement volume, as a third control signal, to a pump regulator, and the pump regulator for controlling a displacement volume of the hydraulic pump in accordance with the third control signal. In the proposed invention, the second target displacement volume determined by the second control signal in the second signal generating section means is preset such that it is smaller than the first target displacement volume determined by the first control signal when the load pressure of the actuator is relatively low, and it is larger than the first target displacement volume when the load pressure of the actuator is relatively high. By so setting, when the actuator is subject to a light load, the first control signal is selected by the selecting section means and is applied to the pump regulator, whereby the hydraulic pump is controlled to achieve the first target displacement volume determined by the first control signal, providing a metering characteristic as good as in the prior art. When the actuator is subject to a heavy load, the second control signal is selected by the selecting section means and is applied to the pump regulator, whereby the hydraulic pump is controlled to achieve the second target displacement volume which is determined by the second control signal and is larger than the first target displacement volume determined by the first control signal. As a result, the flow rate supplied to the actuator is relatively moderately increased with an increase in the operation amount of the directional control valve, providing a good metering characteristic.

As described above, the prior application is arranged to improve the metering characteristic by increasing the delivery rate of the hydraulic pump under a heavy load. However, because the flow rate supplied to the actuator is not controlled in itself, it is varied upon variations in the load pressure. In other words, the metering characteristic under a heavy load is improved, but the fact that the metering characteristic is varied due to an effect by variations in the load pressure is the same as in the prior art.

An object of the present invention is to provide a hydraulic drive system for a hydraulic working machine, with a directional control valve of center bypass type, which is arranged to offer a good metering characteristic even in a heavy load without being affected by the load.

To achieve the above object, according to the present invention, there is provided a hydraulic drive system for hydraulic working machines comprising a variable displacement hydraulic pump, a first actuator driven by a hydraulic fluid delivered from said hydraulic pump, a first directional control valve of center bypass type having meter-in passages provided with meter-in variable restrictors and a center bypass passage provided with bleed-off variable restrictors for controlling a flow of the hydraulic fluid supplied from said hydraulic pump to said first actuator, first operation means for controlling a stroke amount of said first directional control valve, a low pressure circuit, a center bypass line for connecting said center bypass passage to said low pressure circuit at a point downstream of said bleed-off variable restrictors, and a regulator for controlling a displacement volume of said hydraulic pump, wherein said hydraulic drive system further comprises first operation amount detecting means for detecting a operation amount of said first operation means, first target flow rate setting means for setting a first target flow rate of said first actuator in accordance with said operation amount detected, flow rate determinate means for determining an actual actuator flow rate supplied to said first actuator, and regulator control means for controlling the drive of said regulator so that said actual actuator flow rate comes closer to said first target flow rate.

In the present invention thus arranged, the first operation amount detecting means detects the operation amount of the first operation means, and the first target flow rate setting means sets the first target flow rate of the first actuator in accordance with the operation amount detected. On the other hand, the flow rate determinate means determines the actual actuator flow rate supplied to the first actuator. Then, the regulator control means controls the drive of the regulator so that the actual actuator flow rate comes closer to the first target flow rate. Thus, when the actuator flow rate is smaller than the first target flow rate, the operation of the regulator is controlled to increase the actuator flow rate, and when the actuator flow rate is larger than the first target flow rate, the operation of the regulator is controlled to reduce the actuator flow rate. Accordingly, the actuator flow rate depending on the operation amount of the first operation means can be supplied to the actuator and hence a metering characteristic can be improved. At this time, since the actuator flow rate is in itself controlled unlike prior application, the metering characteristic is not affected by variations in the load pressure. As a result, a satisfactory metering characteristic can always be obtained regardless of whether the load is light or heavy.

In the above hydraulic drive system for hydraulic working machines, preferably, said regulator control means comprises first target displacement volume calculating means for calculating a first target displacement volume of said hydraulic pump so as to provide a pump delivery rate at which said actuator flow rate comes closer to said first target flow rate, and drive signal generating means for generating a drive signal for said regulator in accordance with said first target displacement volume.

With such an arrangement, when the actuator flow rate is smaller than the first target flow rate, the regulator control means increases the pump delivery rate to increase the actuator flow rate, and when the actuator flow rate is larger than the first target flow rate, the regulator control means reduces the pump delivery rate to reduce the actuator flow rate, so that the actuator flow rate may come closer to the first target flow rate.

In the above hydraulic drive system for hydraulic working machines, preferably, said flow rate determinate means comprises first flow rate detecting means for detecting a first flow rate passing through said center bypass passage, second flow rate detecting means for detecting a second flow rate delivered from said hydraulic pump, and means for calculating, as said actuator flow rate, the difference between said first flow rate and said second flow rate.

With such an arrangement, the actual actuator flow rate supplied to the first actuator can be determined.

In the above hydraulic drive system for hydraulic working machines, preferably, said first flow rate detecting means comprises pressure generating means disposed in said center bypass line, differential pressure detecting means for detecting a differential pressure across said pressure generating means, and means for calculating said first flow rate in accordance with said differential pressure detected.

With such an arrangement, the first flow rate passing through the center bypass can be determined.

In the above hydraulic drive system for hydraulic working machines, preferably, said regulator control means is means for controlling the drive of said regulator so that said actuator flow rate becomes equal to said first target flow rate.

With such an arrangement, means for making the actuator flow rate come closer to the first target flow rate can be realized.

Preferably, the above hydraulic drive system for hydraulic working machines further comprises pressure generating means disposed in said center bypass line, pressure detecting means for detecting a pressure generated by said pressure generating means, second target displacement volume calculating means for calculating a second target displacement volume of said hydraulic pump so as to provide a pump delivery rate depending on said detected pressure, and means for selecting the larger one of said first and second target displacement volumes and outputting the selected one to said drive signal generating means, wherein said drive signal generating means is means for generating a drive signal for said regulator in accordance with said selected target displacement volume.

With such an arrangement, for example, it is possible to select the second target displacement volume depending on the detected pressure under a light load, and the first target displacement volume for making the actuator flow rate come closer to the first target flow rate under a heavy load. In other words, the control in accordance with the actuator flow rate and the so-called negative control can be selectively employed depending on whether the load is large or small.

In the above hydraulic drive system for hydraulic working machines, preferably, said first operation means is means for outputting a first signal to move said first directional control valve in one direction from the neutral position and a second signal to move said first directional control valve in the other direction from the neutral position, and said first operation amount detecting means is means for detecting the operation amount as given by said first signal.

With such an arrangement, even for the same actuator, it is possible to apply the control in accordance with the actuator flow rate in one direction of operation, and not to apply that control in the other direction of operation. With regard to the boom cylinder, for example, the system can be arranged to apply the control in accordance with the actuator flow rate only in a direction in which the boom cylinder is extended (a boom-up direction), i.e., under a heavy load, and not to apply that control in a direction in which the boom cylinder is contracted (a boom-down direction), i.e., under a light load. In other words, the control in accordance with the actuator flow rate and the so-called negative control can be selectively employed depending on the direction of operation.

Preferably, the above hydraulic drive system for hydraulic working machines further comprises a second actuator and a second directional control valve of center bypass type having meter-in passages provided with meter-in variable restrictors and a center bypass passage provided with bleed-off variable restrictors for controlling a flow of the hydraulic fluid supplied from said hydraulic pump to said second actuator.

With such an arrangement, in the combined operation where a plurality of actuators are driven, it is possible to apply the control in accordance with the actuator flow rate to either one of the first and second actuators, and not to apply that control to the other actuator. In other words, the control in accordance with the actuator flow rate and the so-called conventional negative control can be selectively employed depending on the actuators.

Preferably, the above hydraulic drive system for hydraulic working machines further comprising a second actuator, a second directional control valve of center bypass type having meter-in passages provided with meter-in variable restrictors and a center bypass passage provided with bleed-off variable restrictors for controlling a flow of the hydraulic fluid supplied from said hydraulic pump to said second actuator, second operation means for controlling a stroke amount of said second directional control valve, second operation amount detecting means for detecting a operation amount of said second operation means, second target flow rate setting means for setting a second target flow rate of said second actuator in accordance with said operation amount detected, and means for determining a total target flow rate as given by the sum of said first target flow rate and said second target flow rate, wherein said flow rate determinate means is means for determining a total actuator flow rate as given by the sum of actual actuator flow rates supplied to said first and second actuators, and said regulator control means is means for controlling the drive of said regulator so that said total actuator flow rate comes closer to said total target flow rate.

With such an arrangement, even in the combined operation of driving a plurality of actuators, the control in accordance with the actuator flow rate can be applied to both the first and second actuators.

Preferably, the above hydraulic drive system for hydraulic working machines further comprises third target displacement volume calculating means for calculating a third target displacement volume of said hydraulic pump so as to provide a pump delivery rate depending on said operation amount detected by said first operation amount detecting means, and means for selecting the larger one of said first and third target displacement volumes and outputting the selected one to said drive signal generating means, wherein said drive signal generating means is means for generating a drive signal for said regulator in accordance with said selected target displacement volume.

With such an arrangement, for example, the highly responsive third target displacement volume in accordance with the operation amount of the first operation means is selected during a transient period at the beginning of the operation, and the first target displacement volume for making the actuator flow rate come closer to the first target flow rate is selected in the stable operation. In other words, a response of the actuators at the beginning of the operation can be improved with combination of the control in accordance with the actuator flow rate and the so-called positive control.

Preferably, the above hydraulic drive system for hydraulic working machines further comprises delivery pressure detecting means for detecting a delivery pressure of said hydraulic pump, and compensating means for compensating said second flow rate depending on said delivery pressure detected.

With such an arrangement, the actual actuator flow rate supplied to the first actuator can be determined with higher accuracy.

Preferably, the above hydraulic drive system for hydraulic working machines further comprises a prime mover for driving said hydraulic pump, fourth target displacement volume calculating means for calculating a fourth target displacement volume of said hydraulic pump so as to limit an input torque of said hydraulic pump to be not greater than an output torque of said prime mover, and means for selecting the smaller one of said first and fourth target displacement volumes and outputting the selected one to said drive signal generating means, wherein said drive signal generating means is means for generating a drive signal for said regulator in accordance with said selected target displacement volume.

With such an arrangement, it is possible to prevent the input torque of the hydraulic pump from exceeding the output torque of the prime mover and hence to prevent the prime mover from stalling.

BRIEF DESCRIPTION OF THE DRAWINGS

FIG. 8 as a diagram showing control modes of the controller shown in FIG. 1.

FIG. 12 is a diagram showing control modes of the controller shown in FIG. 10.

FIG. 14 is a diagram showing control modes of the controller shown in FIG. 13.

BEST MODE FOR CARRYING OUT THE INVENTION

Hereinafter, embodiments of a hydraulic drive system for hydraulic working machines of the present invention will be described with reference to the drawings.

First Embodiment

A description will be given of a first embodiment of the present invention by referring to FIGS. 1 to 9.

Figure 1:
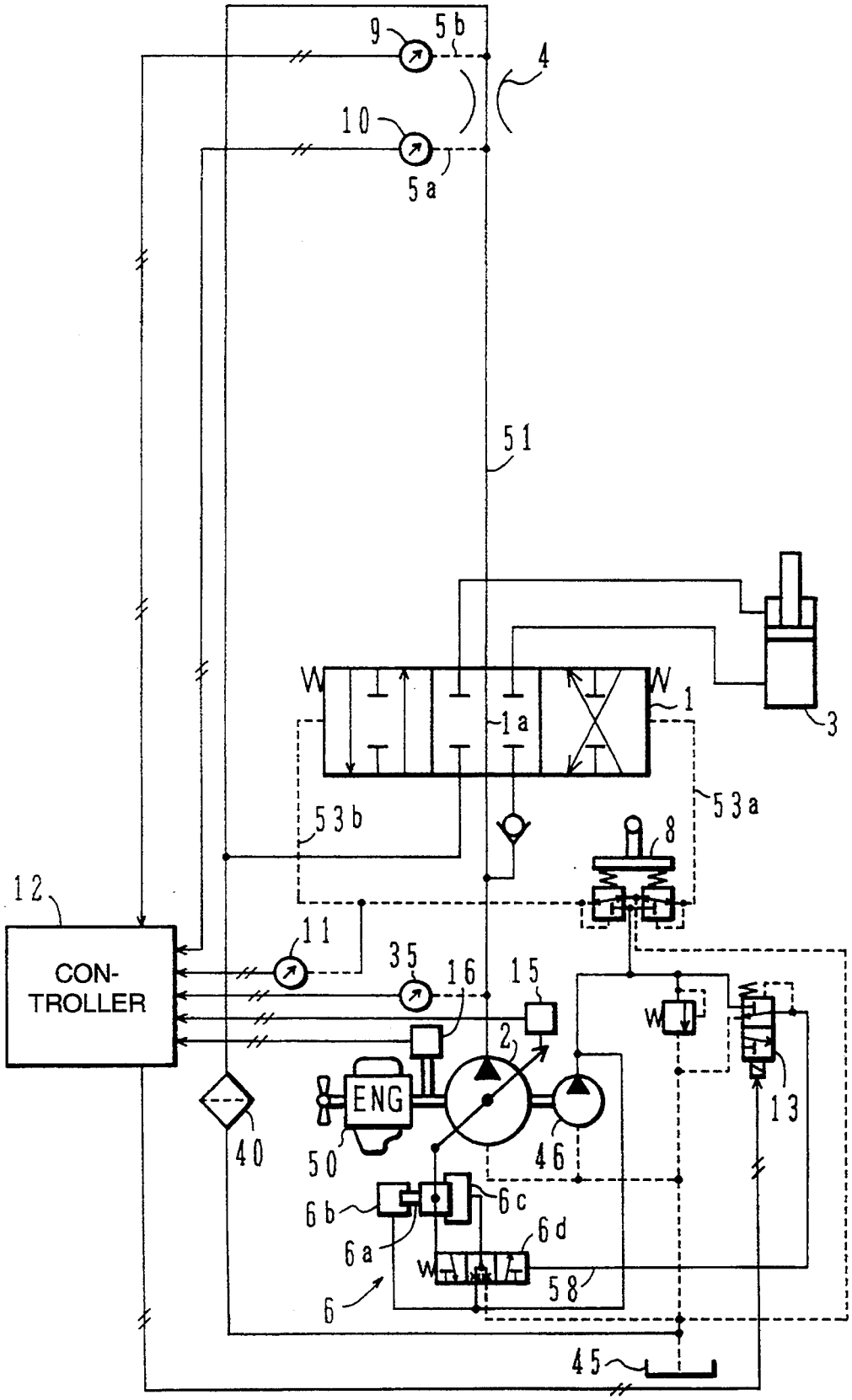
FIG. 1 is a circuit diagram of a hydraulic drive system for hydraulic working machines according to a first embodiment of the present invention.

FIG. 1 shows a circuit diagram of a hydraulic drive system for hydraulic working machines according to this embodiment.

In FIG. 1, the hydraulic drive system of this embodiment is incorporated in a hydraulic excavator, for example, and comprises a prime mover 50, a variable displacement hydraulic pump 2 driven by the prime mover 50, an actuator, e.g., a boom cylinder 3, driven by a hydraulic fluid delivered from the hydraulic pump 2, a boom directional control valve 1 of center bypass type for controlling a flow of the hydraulic fluid supplied from the hydraulic pump 2 to the boom cylinder 3, operation means, e.g., a control lever 8, for controlling a stroke amount of the boom directional control valve 1, an auxiliary hydraulic pump 46 driven by the prime mover 50 and serving as a hydraulic source for a pilot pressure produced by the control lever 8, and a center bypass line 51.

Figure 2:
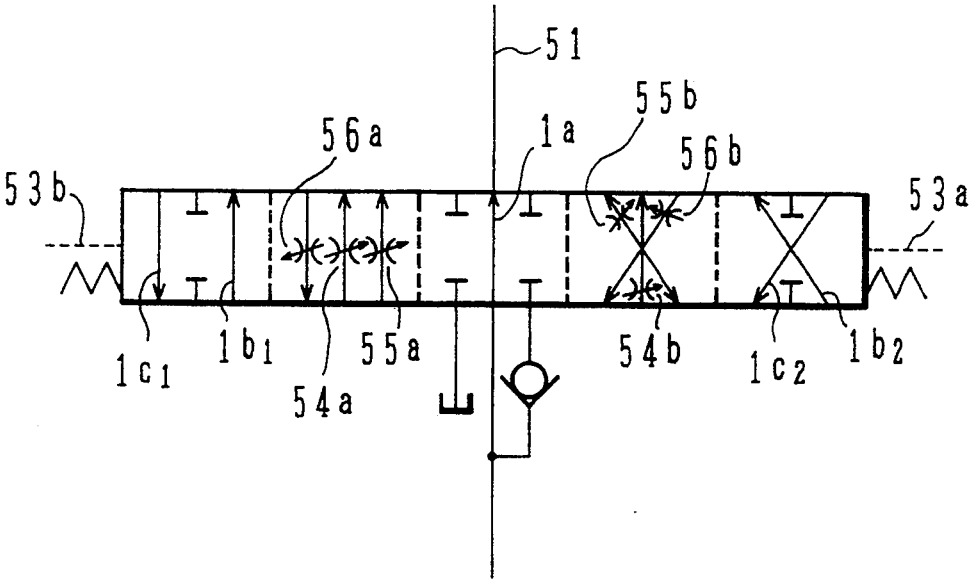
FIG. 2 is an explanatory view showing a transient position of a boom directional control valve.

The boom directional control valve 1 is a pilot-operated valve driven by a pilot pressure introduced through a pilot line 53*a*, 53*b*, and includes a center bypass passage 1*a*, meter-in passages $1b_1$, $1b_2$ and meter-out passages $1c_1$, $1c_2$ as shown in FIG. 2. The center bypass passage 1*a* is provided with bleed-off variable restrictors 54*a*, 54*b*, the meter-in passages $1b_1$, $1b_2$ are provided with meter-in variable restrictors 55*a*, 55*b*, and the meter-out passages $1c_1$, $1c_2$ are provided with meter-out variable restrictors 56*a*, 56*b*, respectively. Downstream of the bleed-off variable restrictors 54*a*, 54*b*, the center bypass passage 1*a* is connected to a low pressure circuit, e.g., a reservoir 45, via the center bypass line 51. Between the reservoir 52 and a restriction valve 4 (described later), there is disposed a filter 40 for cleaning the hydraulic fluid flowing through the circuit.

Figure 3A:
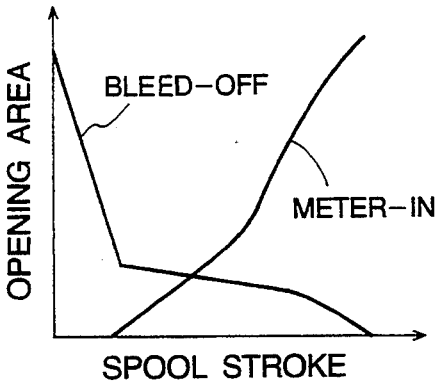
FIG. 3A is a graph showing the relationship of a spool stroke of the directional control valve versus opening areas of a bleed-off variable restrictor and a meter-in variable restrictor.

When the boom directional control valve 1 is gradually shifted from a neutral position through its stroke, the relationship between an opening area of the bleed-off variable restrictors 54*a*, 54*b* and an opening area of the meter-in variable restrictors 55*a*, 55*b* exhibits characteristics as shown in FIG. 3A. More specifically, the opening area of the bleed-off variable restrictors 54*a*, 54*b* is gradually diminished with an increase in the spool stroke and, to the contrary, the opening area of the meter-in variable restrictors 55*a*, 55*b* is gradually enlarged with an increase in the spool stroke.

Returning to FIG. 1 again, the hydraulic drive system of this embodiment further comprises a pressure generator, e.g., a restriction valve 4, disposed in the center bypass line 51, lines 5*a*, 5*b* for respectively introducing pressures upstream and downstream of the restriction valve 4, pressure sensors 9, 10 for respectively detecting the magnitudes of the pressures introduced through the lines 5*a*, 5*b* and outputting electric detection signals corresponding to the detected magnitudes, a pressure sensor 11 for detecting the magnitude of a pilot pressure introduced through a pilot line 53*b* and outputting an electric detection signal corresponding to the detected magnitude, a pump tilt angle sensor 15 for detecting a tilt angle of a swash plate of the hydraulic pump 2 and outputting an electric detection signal corresponding to the detected angle, a pump rotational speed meter 16 for detecting rotational speed of the hydraulic pump 2 and outputting an electric detection signal corresponding to the detected rotational speed, a delivery pressure sensor 35 for detecting a delivery pressure of the hydraulic pump 2 and outputting an electric detection signal corresponding to the detected delivery pressure, a controller 12 for receiving the above detection signals: to execute an arithmetic operation based on the received signals and outputting an electric drive signal, a solenoid proportional valve 13 driven by the drive signal output from the controller 12 for producing a control pressure by using a hydraulic fluid from the auxiliary hydraulic pump 46 to control the magnitude of the pilot pressure supplied to drive section of regulator 6, a pressure signal line 58 for introducing the control pressure produced by the solenoid proportional valve 13, and a regulator 6 for controlling a displacement volume of the hydraulic pump 2 in accordance with the control pressure output to the pressure signal line 58.

Figure 4:
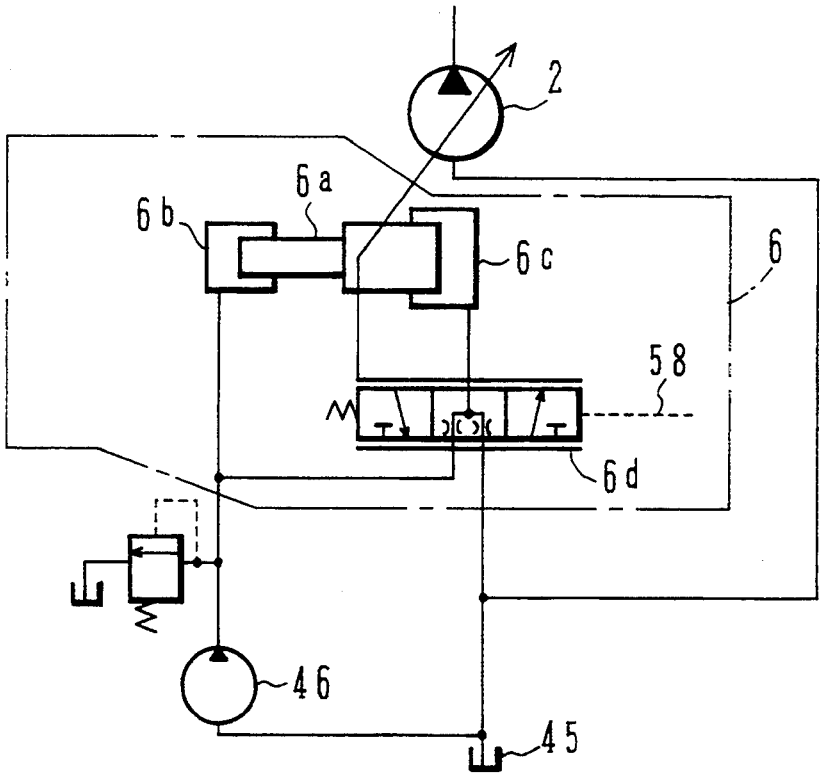
FIG. 4 is a circuit diagram showing the construction of a regulator shown in FIG. 1.

The detailed structure of the regulator 6 is shown in FIG. 4. The regulator 6 comprises a piston 6*a*, a small diameter chamber 6*b* and a large diameter chamber 6*c* for respectively accommodating opposite ends of the piston 6*a*, and a flow control spool 6*d* operated in accordance with the control pressure introduced through the pressure signal line 58. The small diameter chamber 6*b* is connected to a delivery line of the auxiliary hydraulic pump 46, and the large diameter chamber 6*c* is selectively connectable to the small diameter chamber 6*c* or the reservoir 45 depending on an operation of the flow control spool 6*d*.

The regulator 6 has characteristics as follows. When the control pressure is high, the flow control valve 6*d* is moved to the left in FIG. 4, whereupon the small diameter chamber 6*b* and the large diameter chamber 6*c* are communicated with each other. At this time, the pressure of the auxiliary hydraulic pump 46 is supplied to both the small diameter chamber 6*b* and the large diameter chamber 6*c* for moving the piston 6*a* to the left in FIG. 4 due to a difference in pressure receiving area between the small diameter chamber 6*b* and the large diameter chamber 6*c*. As a result, the hydraulic pump 2 is controlled to be kept at a relatively small predetermined capacity (displacement volume) 10*a*, as shown in FIG. 5.

Figure 5:
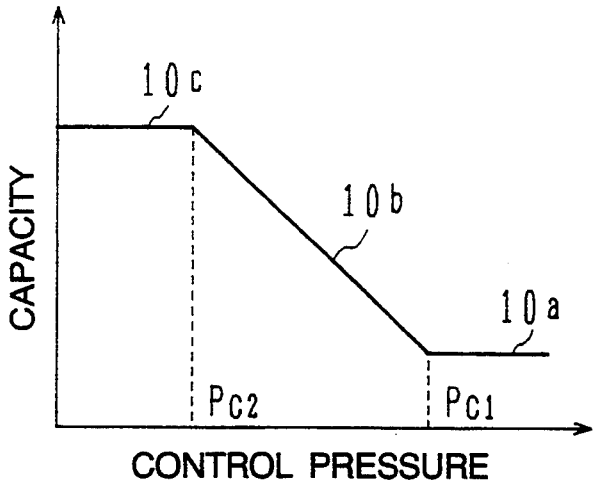
FIG. 5 is a graph showing a control characteristic of the regulator shown in FIG. 4.

Then, when the control pressure lowers down to a value smaller than $P_{c1}$ shown in FIG. 5, the flow control spool 6*d* shown in FIG. 4 is moved to the right in the drawing, whereupon the large diameter chamber 6*c* is now communicated with the reservoir 45. Therefore, the piston 6*a* is moved to the right in the drawing by the pump pressure applied to the small diameter chamber 6*b*. As a result, as shown in FIG. 5, the hydraulic pump 2 is controlled to have a capacity 10*b* which progressively increases from the above capacity 10*a*.

Further, when the control pressure lowers down to a value smaller than $P_{c2}$ shown in FIG. 5, the hydraulic pump 2 is controlled to have a predetermined maximum capacity 10*c* shown in FIG. 5.

Figure 6:
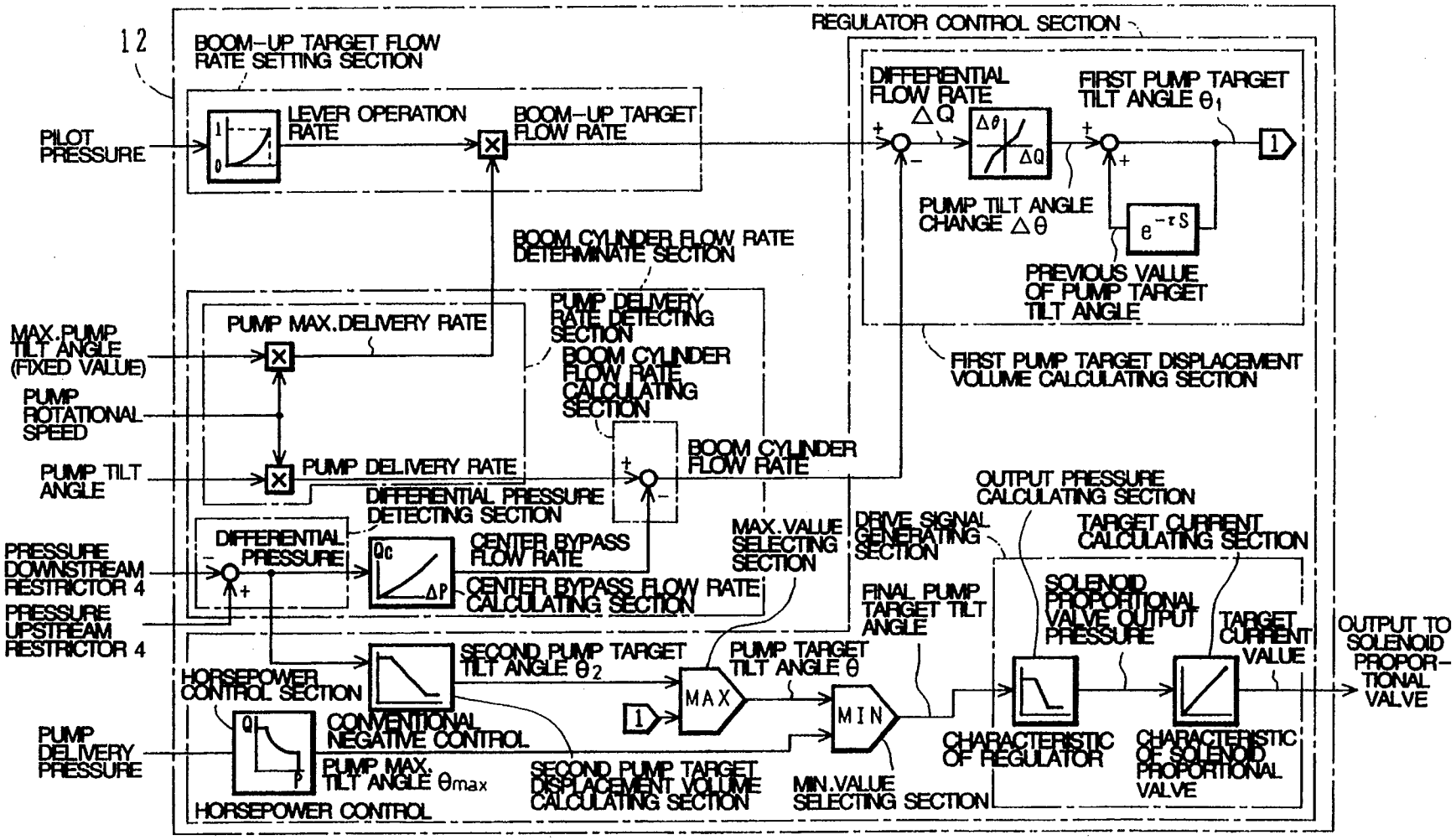
FIG. 6 is a block diagram showing control functions of a controller shown in FIG. 1.

Details of the control executed by the controller 12 is shown in FIG. 6.

First, a pump delivery rate detecting section provided in a boom cylinder flow rate determinate section reads the pump rotational speed based on the pump rotational speed signal applied from the pump rotational speed meter 16, and multiplies the pump rotational speed by a maximum pump tilt angle, which is determined by specification values of the pump and has been input thereto beforehand, for obtaining a maximum delivery rate of the hydraulic pump 2.

Figure 7:
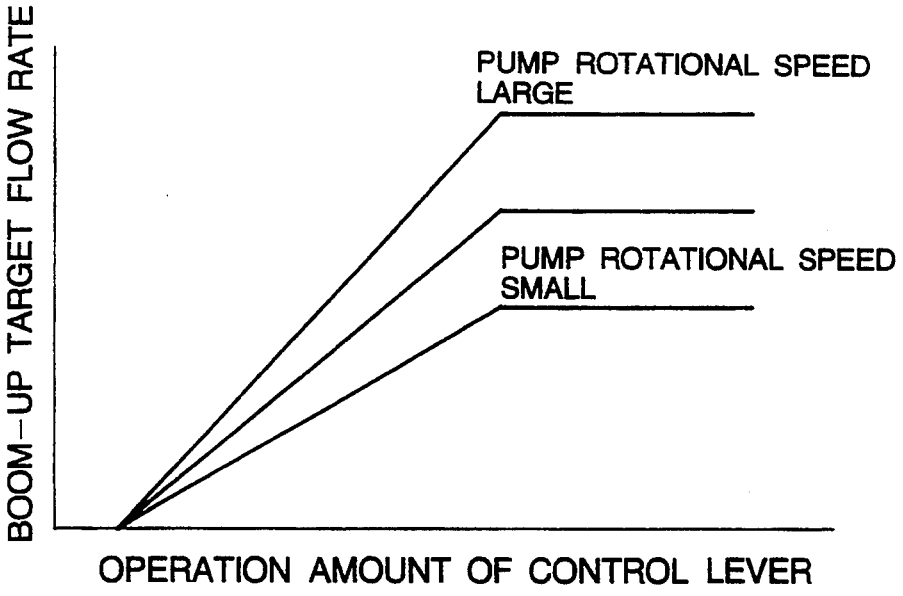
FIG. 7 is a graph showing a control characteristic of the controller shown in FIG. 1.

Then, when the control lever 8 is operated in a direction of extension of the boom cylinder 3 (i.e., in a boom-up direction), the pilot pressure is produced in the pilot line 53*b* and is detected by the pressure sensor 11, following which a corresponding pilot pressure signal is input to a boom-up target flow rate setting section. In the boom-up target flow rate setting section, the operation amount by which the control lever 8 is operated is detected from the pilot pressure signal and then converted into a lever operation rate. The lever operation rate is multiplied by the maximum delivery rate of the hydraulic pump 2, which is applied from the pump delivery rate detecting section, for calculating a boom-up target flow rate. The relationship between the operation amount of the control lever 8 and the boom-up target flow rate in the above process is given as shown in FIG. 7, for example, depending on the pump rotational speed.

Further, the pump delivery rate detecting section reads the pump tilt angle based on the pump tilt angle signal applied from the pump tilt angle sensor 15, and calculates the current pump delivery rate from both the pump tilt angle and the pump rotational speed previously read.

Then, a differential pressure detecting section reads pressures upstream and downstream of the restriction valve 4 applied respectively from the pressure sensors 9, 10, and a center bypass flow rate calculating section calculates a flow rate of the hydraulic fluid passing through the center bypass line 51 from the differential pressure therebetween. The relationship between that differential pressure and the center bypass flow rate is determined by a characteristic of the restriction valve 4.

A boom cylinder flow rate calculating section subtracts the center bypass flow rate from the pump delivery rate previously obtained, for calculating a boom cylinder flow rate, which is actually supplied to the boom cylinder 3.

Moreover, a first pump target displacement volume calculating section provided in a regulator control section subtracts the boom cylinder flow rate from the boom-up target flow rate to calculate a differential flow rate $\Delta Q$ therebetween.

Next, a pump tilt angle change $\Delta\theta$ corresponding to the differential flow rate $\Delta Q$ is determined. At this time, a dead zone may be set so that the pump tilt angle is neither increased nor reduced when the differential flow rate $\Delta Q$ is small. This is because the boom-up target flow rate is not always coincident with the boom cylinder flow rate due to errors in measurement by the sensors, and the control tends to become unstable in, for example, that the pump tilt angle is subject to hunting with the small differential flow rate $\Delta Q$. Then, the pump tilt angle change $\Delta\theta$ is added to the previous pump tilt angle change (i.e., integrated) for calculating a first pump target tilt angle $\theta_1$ (i.e., first target displacement volume).

While the first pump target tilt angle $\theta_1$ is obtained as above, a second pump target displacement volume calculating section provided in the regulator control section calculates a second pump target tilt angle $\theta_2$ (i.e., second target displacement volume) for the conventional negative control depending on the differential pressure previously determined by the differential pressure detecting section. This corresponds to such an alternative manner as that the second pump target tilt angle $\theta_2$ (i.e., second target displacement volume) is calculated depending on the pressure upstream of the restriction valve 4 which is detected by the pressure sensor 10. However, the above method of using the differential pressure between the upstream and downstream pressures rather than only the upstream pressure has an advantage of being able to prevent an effect of hunting due to variations in the flow rate. In the case where no consideration is needed for hunting or a relief valve is provided in addition to the restriction valve 4, only the upstream pressure detected by the pressure sensor 10 may be used. After the second pump target tilt angle $\theta_2$ has thus been determined, the first pump target tilt angle $\theta_1$ and the second pump target tilt angle $\theta_2$ are compared in magnitude with each other and the larger one is selected as a pump target tilt angle $\theta$.

Next, a horsepower controlling section reads the pump delivery pressure based on the pump delivery pressure signal applied from the delivery pressure sensor 35, and determines a pump maximum delivery rate, i.e., a pump maximum tilt angle $\theta_{max}$, available under the read pump delivery pressure through the so-called horsepower control with which an :input torque of the hydraulic pump 2 is held to be not greater than an output torque of the prime mover 5. The smaller one of the pump maximum tilt angle $\theta_{max}$ and the pump target tilt angle $\theta$ previously selected is selected as a final pump target tilt angle in a minimum value selecting section.

Furthermore, an output pressure selecting section provided in a drive signal generating section calculates an output pressure from the solenoid proportional valve 13, which is required to achieve the pump target tilt angle selected, in accordance with a characteristic of the regulator 6.

Finally, a target current calculating section calculates, in accordance with a characteristic of the solenoid proportional valve, a target current value necessary for causing the solenoid proportional valve 13 to output the pressure calculated above, the target current value being output to the solenoid proportional valve 13.

When the control lever 8 is operated in a direction in which the boom cylinder 3 is contracted (i.e., in a boom-down direction), the pressure in the pilot line **53*b* is equal to the reservoir pressure and no pilot pressure is produced. Therefore, the boom-up target flow rate set by the boom-up target flow rate setting section in the controller 12** is zero and the first pump target tilt angle $\theta_1$ set by the first pump target displacement volume calculating section is also zero. Thus, the second pump target tilt angle $\theta_2$ set by the second pump target displacement volume calculating section is always selected by the maximum value selecting section, and the smaller one of the second pump target tilt angle $\theta_2$ and the pump maximum tilt angle $\theta_{max}$ output from the horsepower controlling section is compared in the minimum value selecting section. The subsequent control in the drive signal generating section is the same as described above.

In the foregoing arrangement, the control lever 8 and the pilot lines **53*a*, 53*b* make up first operation means for controlling the stroke amount of the boom directional control valve 1. The pilot pressure as produced when the control lever 8 is operated to the left in FIG. 1 with intent to effect a boom-up operation functions as a first signal for moving the boom directional control valve 1 in one direction from the neutral position, and the pilot pressure as produced when the control lever 8 is operated to the right in FIG. 1 with intent to effect a boom-down operation functions as a second signal for moving the boom directional control valve 1** in the other direction from the neutral position. The control lever 8 also constitutes means for outputting the first and second signals.

The pressure sensor 11 constitutes first operation amount detecting means for detecting the operation amount of the control lever 8 as given by the first signal.

The boom-up target flow rate setting section in the controller 12 constitutes first target flow rate setting means for setting the boom-up target flow rate of the boom cylinder 3 in accordance with the operation amount detected.

The restriction valve 4 disposed in the center bypass line 51 to constitute pressure generating means, the pressure sensors 9, 10, the lines **5*a*, 5*b* and the differential pressure detecting section in the controller 12 which jointly constitute differential pressure detecting means for detecting the differential pressure across the restriction valve 4, and the center bypass flow rate calculating section constituting means for calculating the center bypass flow rate make up first flow rate detecting means for detecting the flow rate of-the hydraulic fluid passing through the center bypass passage la, i.e., the center bypass flow rate. The pump tilt angle sensor 15, the pump rotational speed meter 16, and the pump delivery rate detecting section in the controller 12 make up second flow rate detecting means for detecting the flow rate of the hydraulic fluid delivered from the hydraulic pump 2, i.e., the pump delivery rate. The boom cylinder flow rate calculating section in -the controller 12 constitutes means for calculating, as the boom cylinder flow rate, the difference between the pump delivery rate and the center bypass flow rate. All of the above means make up flow rate determinate means for determining the flow rate of the hydraulic fluid supplied to the boom cylinder 3**, i.e., the boom cylinder flow rate.

Further, the first pump target displacement volume calculating section in the controller 12 constitutes first target displacement volume calculating means for calculating the first target displacement volume of the hydraulic pump 2 so as to provide the pump delivery rate at which the boom cylinder flow rate comes closer to the boom-up target flow rate. The control pressure output from the solenoid proportional valve 13 through the pressure signal line 58 functions as a drive signal for the regulator 6. The drive signal generating section in the controller 12 and the solenoid proportional valve 13 make up drive signal generating means for generating the drive signal for the regulator 6 in accordance with the first target displacement volume. The regulator control section in the controller 12 and the solenoid proportional valve 13 make up regulator control means for controlling the drive of the regulator 6 so that the boom cylinder flow rate comes closer to the boom-up target flow rate, and also make up means for controlling the drive of the regulator 6 so that the boom cylinder flow rate becomes equal to the boom-up target flow rate.

Moreover, the pressure sensor 10 constitutes pressure detecting means for detecting the pressure generated by the restriction valve 4 as the pressure generating means, and the second target displacement volume calculating section in the controller 12 constitutes second pump target displacement volume calculating means for calculating the second target displacement volume of the hydraulic pump 2 so as to provide the pump delivery rate depending on the detected pressure. The maximum value selecting section constitutes means for selecting the larger one of the first and second target displacement volumes and outputting the selected one to the drive signal generating means.

Additionally, the horsepower controlling section in the controller 12 constitutes fourth target displacement volume calculating means for calculating the fourth target displacement volume of the hydraulic pump 2 to limit the input torque of the hydraulic pump to be not greater than the output torque of the prime mover. The minimum value selecting section constitutes means for selecting the smaller one of the first and fourth target displacement volumes and outputting the selected one to the drive signal generating means.

This embodiment constructed as explained above operates as follows.

Figure 3C:
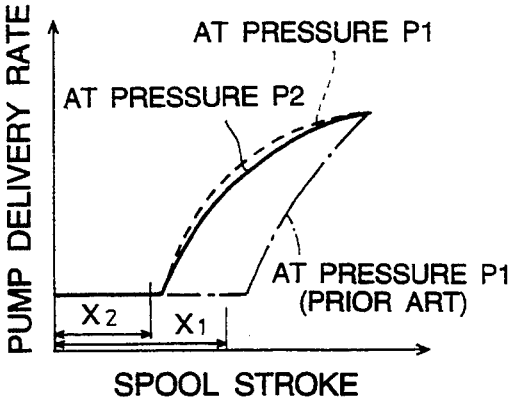
FIG. 3C is a graph showing the relationship between the spool stroke of the directional control valve and a delivery rate of a hydraulic pump.
Figure 3B:
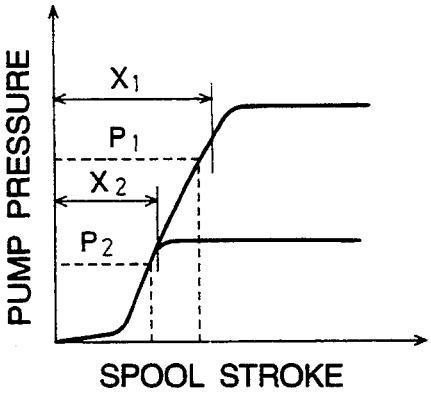
FIG. 3B is a graph showing the relationship between the spool stroke of the directional control valve and a delivery pressure of a hydraulic pump.

Assume now, for example, that under a light load with the bucket kept empty, i.e., where the load pressure is relatively small as indicated by P2 in FIG. 3B, the control lever 8 is operated to the left in FIG. 1 with the intention of extending the boom cylinder 3. Upon the control lever 8 being operated, the hydraulic fluid supplied from the auxiliary hydraulic pump 46 is applied as the pilot pressure through the line 53*b* to a driving sector of the boom directional control valve 1, which is positioned on the left side as shown, and the boom directional control valve 1 is gradually moved through its stroke toward a shift position shown on the left side in FIG. 1 (i.e., to the right).

At the start point of the stroke of the boom directional control valve 1, i.e., when the bleed-off variable restrictor 54*a* disposed in the center bypass passage 1*a* begins to close, the hydraulic pump 2 is kept at the aforementioned predetermined small capacity 10*a* in FIG. 5 to deliver the hydraulic fluid at a standby flow rate which is small corresponding to the capacity 10*a*.

When the boom directional control valve 1 is further moved through its stroke to the right in FIG. 1, as explained above with reference to FIG. 3A, the opening area of the bleed-off variable restrictor 54*a* is gradually diminished, whereby the flow rate of the hydraulic fluid passing through the restriction valve 4 is reduced in comparison with before and the opening area of the meter-in variable restrictor 55*a* is gradually enlarged. Then, the hydraulic pump 2 is communicated with the bottom side of the boom cylinder 3 and the reservoir 45 is communicated with the rod side of the boom cylinder 3, whereupon the delivery rate of the hydraulic pump 2 is supplied to the bottom side of the boom cylinder 3, causing the hydraulic fluid to be returned to the reservoir 45. Simultaneously, as the bleed-off variable restrictor 54*a* is closed, the pressure of the hydraulic fluid delivered from the hydraulic pump 2, i.e., the pump pressure, is raised as shown in FIG. 3B. Then, at the time the pump pressure exceeds P2, the boom cylinder 3 starts moving to gradually extend the boom cylinder 3 since then.

As the boom cylinder 3 starts moving and the hydraulic pump 2 starts supplying the hydraulic fluid to the boom cylinder 3 in that way, the flow rate of the hydraulic fluid passing through the center bypass passage 1*a* is reduced and hence the difference between the pressure upstream of the restriction valve 4 and the pressure downstream thereof detected respectively by the pressure sensors 9, 10. Based on such a reduction in the differential pressure, the second pump target displacement volume calculating section in the controller 12 calculates the second pump target tilt angle $\theta_2$ for the so-called conventional negative control.

In the boom-up operation under a light load like this case, since the load pressure of the boom cylinder 3 is usually small, the second pump target tilt angle $\theta_2$ is larger than the first pump target tilt angle $\theta_1$ described later, the maximum value selecting section selects the second pump target tilt angle $\theta_2$, and the minimum value selecting section selects, as the final pump target tilt angle $\theta$, the smaller one of the second pump target tilt angle $\theta_2$ and the maximum tilt angle $\theta_{max}$ obtained with the horsepower control. The drive signal generating section outputs the target current corresponding to the final pump target tilt angle $\theta$ to the solenoid proportional valve 13 which drives the piston 6*a* of the regulator 6 to the right in FIG. 4. As a result, the delivery rate of the hydraulic pump 2 is gradually increased to provide a predetermined flow rate characteristic, i.e., metering characteristic.

The relationship between the spool stroke of the boom directional control valve 1 and the pump delivery rate obtained at this time is as indicated by a characteristic curve of "at pressure P2" in FIG. 3C. Correspondingly, the relationship between the spool stroke of the boom directional control valve 1 and the boom cylinder flow rate supplied to the boom cylinder 3 is as indicated by a characteristic curve of "at pressure P2" in FIG. 3D.

Figure 3D:
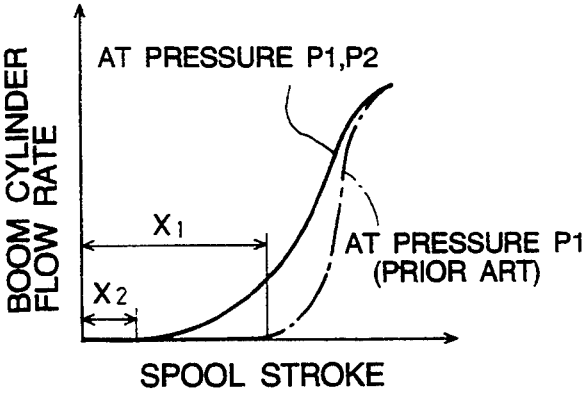
FIG. 3D is a graph showing the relationship between the spool stroke of the directional control valve and a flow rate of boom cylinder.

In other words, since the load pressure of the boom cylinder 3 is provided by the relatively small pressure P2, the pump delivery rate increases relatively moderately with an increase in the spool stroke of the boom directional control valve 1 as indicated by the characteristic curve of "at pressure P2" in FIG. 3C and, correspondingly, the flow rate supplied to the boom cylinder 3 also increases relatively moderately with respect to the spool stroke as indicated by the characteristic curve of "at pressure P2" in FIG. 3D in a similar relation to the characteristic curve of the pump delivery rate. Thus, a satisfactory metering characteristic can be obtained.

As another example, when the control lever 8 is operated to the left in FIG. 1 to gradually move the boom directional control valve 1 through its stroke toward its shift position shown on the left side in FIG. 1 with the intention of extending the boom cylinder 3 under a heavy load with the bucket hanging a burden, i.e., in a situation where the load pressure is considerably large as indicated by P1 in FIG. 3B, the calculation of the first pump target tilt angle $\theta_1$, which has been omitted from the above description, is first performed as follows. During the above shift operation, the pressure sensor 11 detects the pressure applied to the driving sector of the boom directional control valve 1 through the line 53*b*, the pressure sensor 10 detects the pressure upstream of the restriction valve 4 through the line 5*b*, the pressure sensor 9 detects the pressure downstream of the restriction valve 4 through the line 5*a*, the pump tilt angle sensor 15 detects the tilt angle of the swash plate of the hydraulic pump 2, and the pump rotational speed meter 16 detects the rotational speed of the hydraulic pump 2, all of the resultant detection signals being input to the controller 12. As described above, the controller 12 calculates the boom-up target flow rate from the detection signals of the pressure sensor 11 and the pump rotational speed meter 16 in the boom-up target flow rate setting section, calculates the pump delivery rate from the detection signals of the pump tilt angle sensor 15 and the pump rotational speed meter 16 in the pump delivery rate detecting section, and calculates the center bypass flow rate from the detection signals of the pressure sensor 10 and the pressure sensor 9 in the differential pressure detecting section and the center bypass flow rate calculating section. It further calculates the boom cylinder flow rate from the pump delivery rate and the center bypass flow rate, both calculated above, in the boom cylinder flow rate calculating section, and calculates the first pump target tilt angle $\theta_1$ in accordance with the difference between the boom-up target flow rate and the boom cylinder flow rate in the first pump target displacement volume calculating section.

In the boom-up operation under a heavy load like this case, since the load pressure of the boom cylinder is usually large, the first pump target tilt angle $\theta_1$ is larger than the aforementioned second pump target tilt angle $\theta_2$, the maximum value selecting section selects the first pump target tilt angle $\theta_1$, and the minimum value selecting section selects, as the final pump target tilt angle $\theta$, the smaller one of the first pump target tilt angle $\theta_1$ and the maximum tilt angle $\theta_{max}$ obtained with the horsepower control. The drive signal generating section outputs the target current corresponding to the final pump target tilt angle $\theta$ to the solenoid proportional valve 13 which drives the piston 6*a* of the regulator 6 to the right in FIG. 4. As a result, the delivery rate of the hydraulic pump 2 is gradually increased to provide a predetermined flow rate characteristic, i.e., metering characteristic.

The relationship between the spool stroke of the boom directional control valve 1 and the pump delivery rate obtained at this time is as indicated by a characteristic curve of "at pressure P1" in FIG. 3C. The resulting characteristic of the pump delivery rate with respect to the spool stroke is substantially equal to or a little greater than the characteristic of "at pressure P2". Correspondingly, the relationship between the spool stroke of the boom directional control valve 1 and the boom cylinder flow rate supplied to the boom cylinder 3 is as indicated by a characteristic curve of "at pressure P1" in FIG. 3D. Thus, the resulting characteristic of the boom cylinder flow rate with respect to the spool stroke is substantially completely coincident with the characteristic of "at pressure P2". In other words, regardless of whether the load is light or heavy, the flow rate supplied to the boom cylinder 3 is moderately increased with an increase in the spool stroke of the boom directional control valve 1 so that a satisfactory metering characteristic is always provided.

For comparison, the relationship between the spool stroke and the pump delivery rate and the relationship between the spool stroke and the actuator flow rate in the prior art are indicated by one-dot-chain lines in FIGS. 3(*c*) and 3(*d*), respectively. Since the regulator 6 is driven with the second pump target tilt angle $\eta_2$ for the negative control in the prior art even when the load pressure of the boom cylinder 3 is considerably large as indicated by P1 in FIG. 3B, the boom cylinder 3 will not start moving unless the bleed-off variable restrictor 54*a* is throttled to such an extent that the pump pressure rises in excess of P1 under the condition of the hydraulic pump 2 delivering the hydraulic fluid at the standby flow rate. At the pump pressure lower than P1, therefore, the flow rate passing through the center bypass passage la is not reduced and hence the pump delivery rate is not increased. When the opening area of the bleed-off variable restrictor 54*a* is diminished to such an extent that the pump pressure exceeds P1, the flow rate passing through the center bypass passage 1*a* starts reducing, whereupon the pump delivery rate is increased abruptly as indicated by the one-dot-chain line in FIG. 3C. Correspondingly, the flow rate supplied to the boom cylinder 3 is also increased abruptly with respect to the spool stroke of the boom directional control valve 1 in similar relation to the characteristic curve of the pump delivery rate, as indicated by the one-dot-chain line in FIG. 3D, meaning that the metering characteristic is remarkably deteriorated.

With this embodiment, as described above, in addition to providing the metering characteristic as good as conventional under a light load, the boom cylinder flow rate depending on the operation amount of the control lever 8 can be supplied to the boom cylinder 3 under a heavy load to provide the same satisfactory metering characteristic as under a light load. Thus, regardless of whether the load is light or heavy, the satisfactory metering characteristic is always obtained. As a result, the operator can operate a hydraulic working machine with no need of paying considerable care as to whether the load is large or small and, in particular, an inconvenience which has been experienced in the lever operation of the boom directional control valve 1 under a heavy load can be overcome so as to improve the working efficiency. It is also possible to make the operator feel less fatigued with the lever operation.

While the above embodiment has been described taking the boom cylinder 3 as an example of actuators, the present invention is not limited to the above embodiment and the actuator may be of, e.g., an arm cylinder. In this case, when the arm cylinder is operated in a direction in which the arm cylinder is contracted (i.e., in an arm-dump direction), it usually undergoes a heavy load. Control modes in respective operations of the boom cylinder and the arm cylinder are summarized in FIG. 8.

Figure 9:
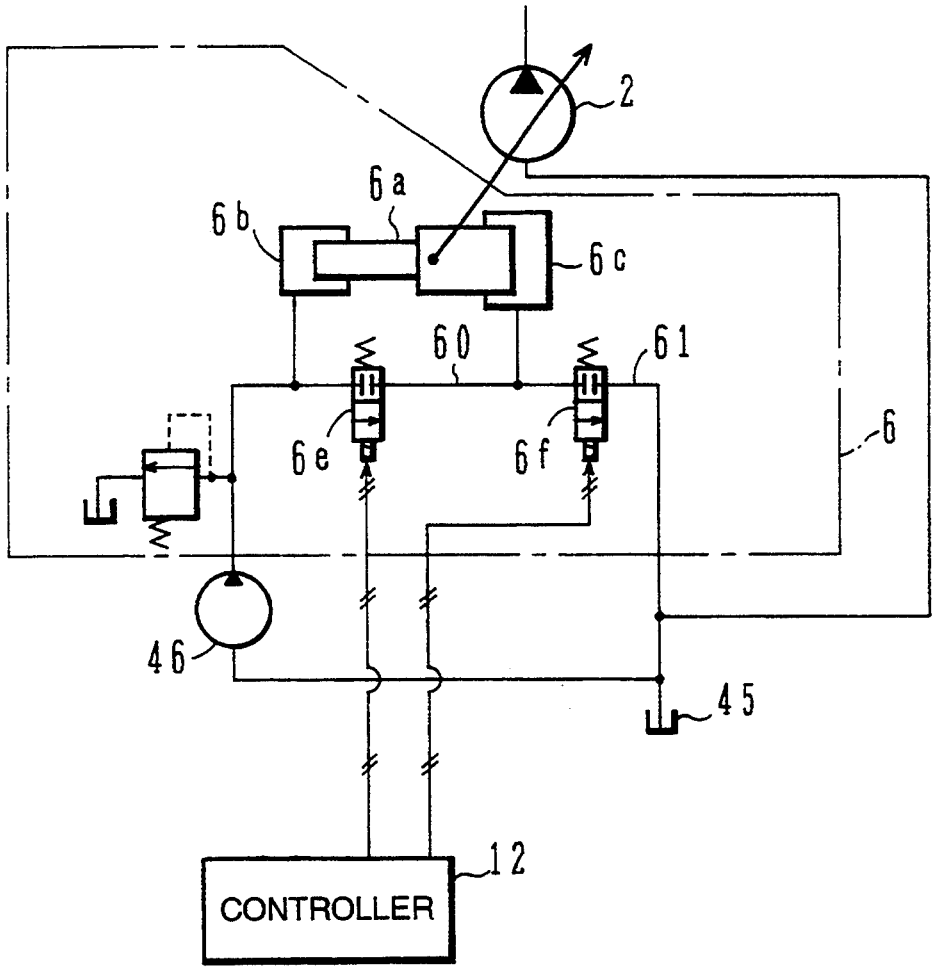
FIG. 9 is a circuit diagram showing the construction of a regulator according to a modification of the first embodiment of the present invention.

In the above embodiment, the regulator 6 is constructed such that the flow control spool 6*d* is operated to move the piston 6*a* in accordance with the control pressure output to the pressure signal line 58. Alternatively, the regulator may be constructed by using two solenoid switching valves rather than the flow control spool. This modification will be described below with reference to FIG. 9. In FIG. 9, identical members to those in FIG. 4 are denoted by the same reference numerals.

The compensated regulator of FIG. 9 is different from the regulator 6 of FIG. 4 in comprising, instead of the flow control spool 6*d*, a first solenoid switching valve 6*e* disposed in a first passage 60, which communicates the small diameter chamber 6*b* and the large diameter chamber 6*c*, for opening and closing the first passage 60 in response to a first control pressure signal from the controller 12, and a second solenoid switching valve 6*f* disposed in a second passage 61, which communicates the large diameter chamber 6*c* and the first passage 60 with the reservoir 45, for opening and closing the second passage 61 in response to a second control pressure signal from the controller 12.

In the regulator 6 shown in FIG. 9, when the first solenoid switching valve 6*e* is kept closed and the second solenoid switching valve 6*f* is energized into an open state, the communication between the small diameter chamber 6*a* and the large diameter chamber 6*c* is cut off and the large diameter chamber 6*c* is communicated with the reservoir. Therefore, the piston 6*a* is moved to the right with the pump pressure applied to the small diameter chamber 6*a*, and the hydraulic pump 2 is controlled to increase its capacity (displacement volume). When the second solenoid switching valve 6*f* is kept closed and the first solenoid switching valve 6*e* is energized into an open state, the pump pressure is supplied to both the small diameter chamber 6*b* and the large diameter chamber 6*c*. Therefore, the piston 6*a* is moved to the left in FIG. 9 due to the difference in pressure receiving area between the small diameter chamber 6*b* and the large diameter chamber 6*c*, and the hydraulic pump 2 is controlled to reduce its capacity (displacement volume).

In this modification, only the drive signal generating section in the controller 12 constitutes the drive signal generating means for generating the drive signal for the regulator 6. This modification can also provide a similar advantage to that in the first embodiment.

Furthermore, while the restriction valve 4 is provided in the above embodiment as the pressure generator to be disposed downstream of the center bypass passage 1*a*, the present invention is not limited the provision of the restriction valve 4 and a relief valve or the like may be provided instead.

Also, in the above embodiment, the restriction valve 4, the pressure sensors 9, 10, the lines 5*a*, 5*b*, the differential pressure detecting section and the center bypass flow rate calculating section, the last twos belonging to the controller 12, are employed as the first flow rate detecting means for detecting the center bypass flow rate passing through the center bypass passage 1*a*. Alternatively, a flowmeter (e.g., a turbine flowmeter) may be provided instead in the center bypass line 51. This compensated case can also provide a similar advantage.

While the pressure sensor 11 for detecting the pressure applied to the driving sector of the boom directional control valve 1 is provided in the above embodiment as the first operation amount detecting means for detecting the operation amount of the control lever 8, the present invention is not limited the provision of the pressure sensor 11 and a stroke sensor or the like for directly detecting the operation amount of the control lever 8 may be provided.

In the above embodiment, the pump tilt angle sensor 15, the pump rotational speed meter 16, and the pump delivery rate detecting section in the controller 12 are employed as the second flow rate detecting means for detecting the pump delivery rate from the hydraulic pump 2. However, a flowmeter (e.g., a turbine flowmeter) may be provided instead between the hydraulic pump 2 and the boom directional control valve 1. As an alternative, the second flow rate detecting means may be constituted by a restriction valve disposed between the hydraulic pump 2 and the boom directional control valve 1 and pressure sensors for detecting pressures upstream and downstream of the restriction valve, respectively, so that the pump delivery rate may be calculated from the differential pressure across the restriction valve.

Further, the above embodiment includes the pressure sensor 9 for detecting the pressure downstream of the restriction valve 4, because the restriction valve 4 is communicated with the reservoir 45 through the filter 40. However, the pressure sensor 9 may be omitted in the case where the side downstream of the restriction valve 4 is directly connected to the reservoir 45.

Additionally, while the solenoid proportional valve 13 is provided in the above embodiment to generate the control pressure for controlling the magnitude of the pilot pressure applied to the driving sector of the regulator 6, a stepping motor or the like may be provided instead so as to directly drive the regulator 6.

Second Embodiment

A second embodiment of the present invention will be described with reference to FIGS. 10 to 14. This embodiment is concerned with a hydraulic drive system for hydraulic working machines in which a plurality of actuators are driven simultaneously.

Figure 10:
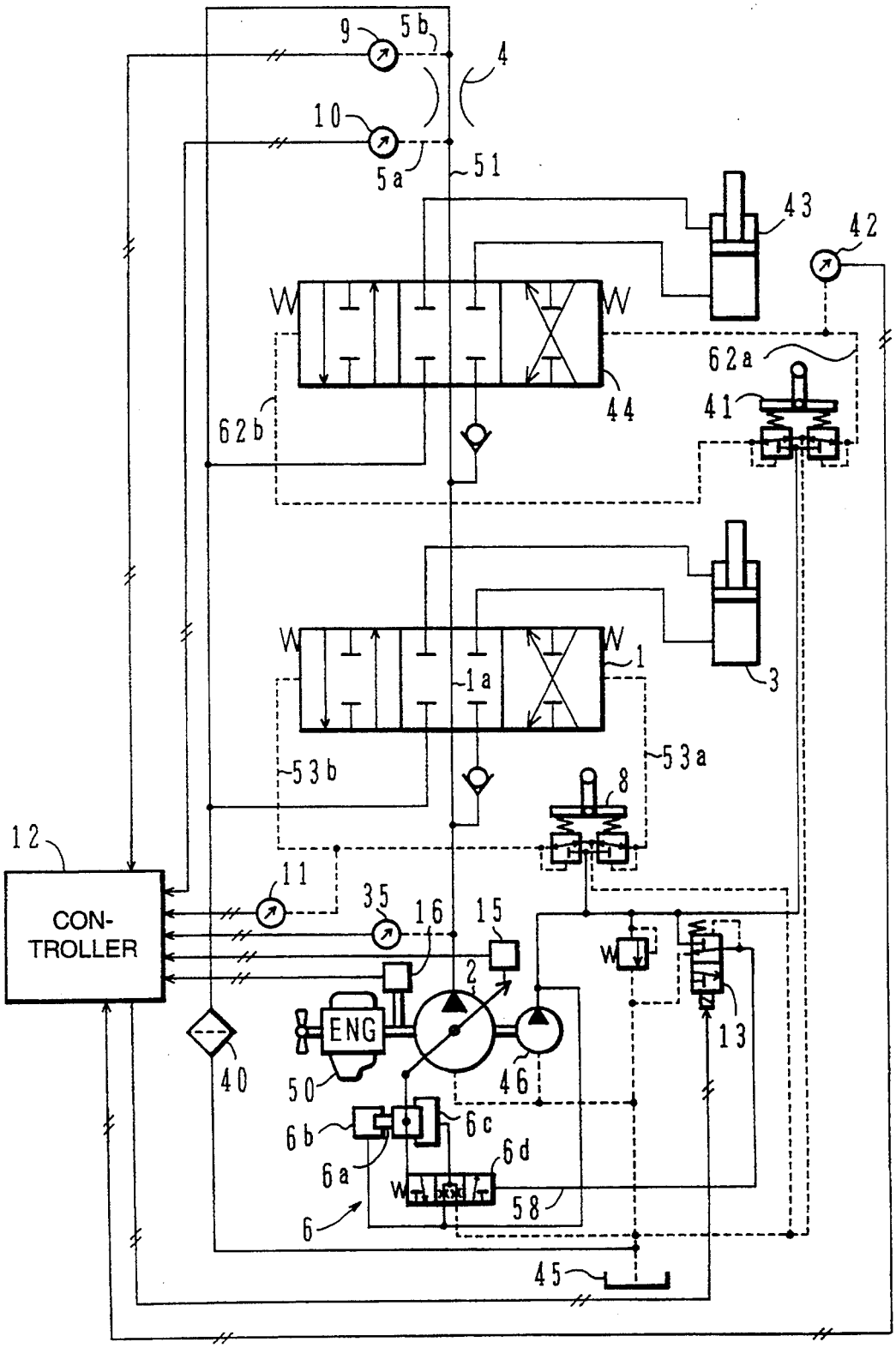
FIG. 10 is a circuit diagram of a hydraulic drive system for hydraulic working machines according to a second embodiment of the present invention.

FIG. 10 shows a circuit diagram of the hydraulic drive system for hydraulic working machines of this embodiment. In FIG. 10, identical members to those in the first embodiment are denoted by the same reference numerals.

Referring to FIG. 10, the hydraulic drive system of this embodiment is different from that of the first embodiment in that an arm cylinder 43 is added as another actuator driven by the hydraulic fluid delivered from the hydraulic pump 2 and, correspondingly, the system comprises an arm directional control valve 44 of center bypass type for controlling a flow of the hydraulic fluid supplied from the hydraulic pump 2 to the arm cylinder 43, operation means, e.g., a control lever 41, for controlling a stroke amount of the arm directional control valve 44, pilot lines 62*a*, 62*b* for introducing a pilot pressure to drive the arm directional control valve 44, and a pressure sensor 42 for detecting the magnitude of the pilot pressure introduced to the pilot line 62*a* for moving the arm directional control valve 44 to a shift position shown on the right side in FIG. 10 (i.e., to the left), and for outputting a pilot pressure signal corresponding to the detected magnitude.

As with the boom directional control valve 1, though not shown, the arm directional control valve 44 includes a center bypass passage, meter-in passages and meter-out passages which are respectively provided with bleed-off variable restrictors, meter-in variable restrictors, and meter-out variable restrictors. The other construction is substantially the same as in the first embodiment.

Figure 11:
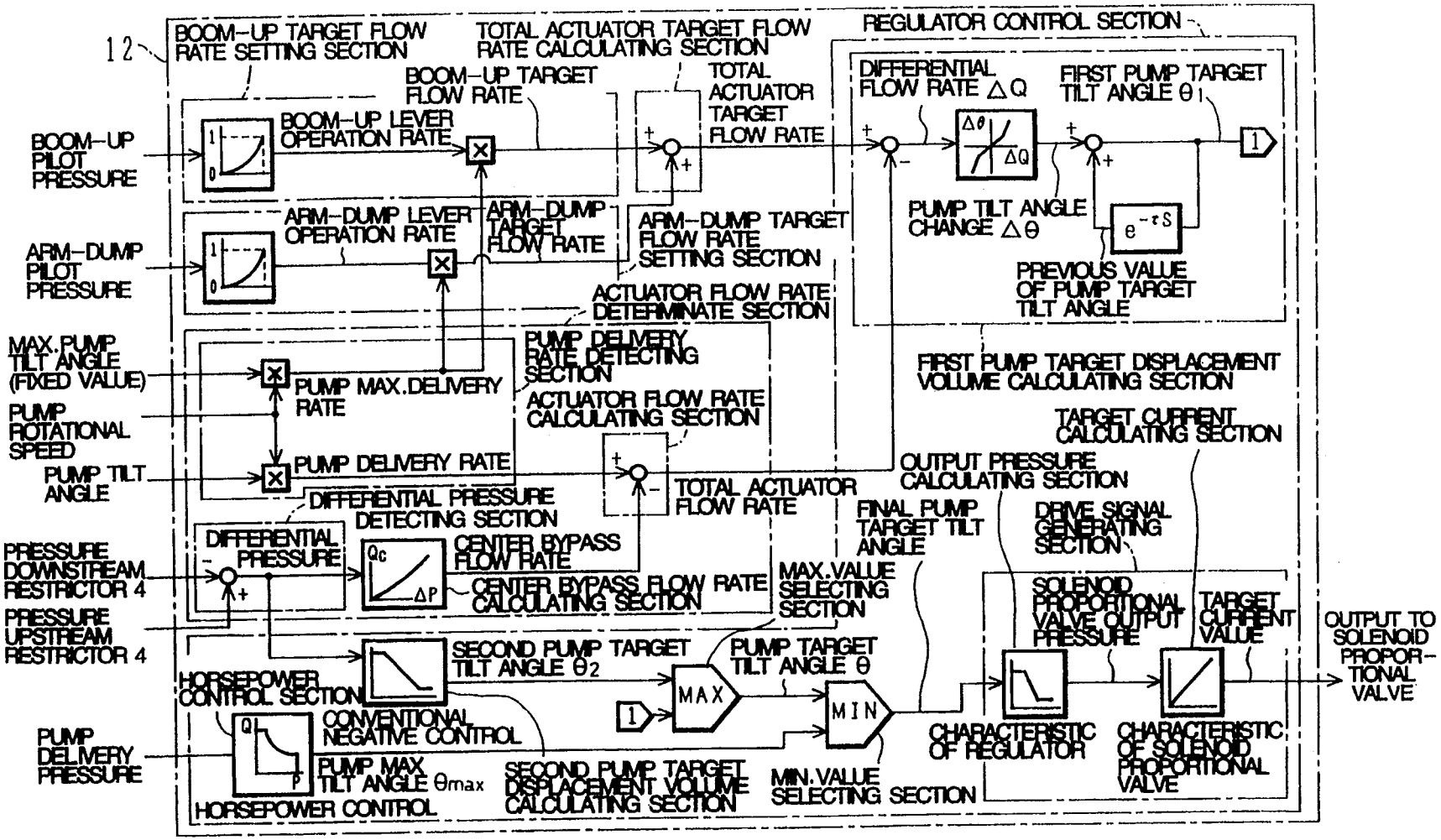
FIG. 11 is a block diagram showing control functions of a controller shown in FIG. 10.

FIG. 11 shows details of the control performed by the controller 12.

One point of differences between the control process shown in FIG. 11 and the control process of the first embodiment shown in FIG. 6 is that an arm-dump target flow rate setting section is provided in addition to the boom-up target flow rate setting section. More specifically, when the control lever 41 is operated to the right in FIG. 11 in a direction of contraction of the arm cylinder 43 (i.e., in an arm-dump direction), the pilot pressure is produced in the pilot line 62*a* and is detected by the pressure sensor 42, following which a corresponding arm-dump pilot pressure signal is input to the arm-dump target flow rate setting section. In the arm-dump target flow rate setting section, the operation amount by which the control lever 41 is operated is detected from the arm-dump pilot pressure signal and then converted into a lever operation rate. As with the boom-up target flow rate setting section, thereafter, the lever operation rate is multiplied in the arm-dump target flow rate setting section by the maximum delivery rate of the hydraulic pump 2, which is applied from the pump delivery rate detecting section, for calculating an arm-dump target flow rate.

Then, a total actuator target flow rate calculating section newly provided calculates, as a total actuator target flow rate, the sum of the above arm-dump target flow rate and the boom-up target flow rate set in the boom-up target flow rate setting section.

In an actuator flow rate determinate section corresponding to the boom flow rate determinate section in the first embodiment, similarly to the first embodiment, the pump delivery rate from the pump delivery rate detecting section and the center bypass flow rate from the center bypass flow rate calculating section are input to an actuator flow rate calculating section corresponding to the boom flow rate calculating section. The actuator flow rate calculating section calculates, as a total actuator flow rate, the difference between the pump delivery flow rate and the center bypass flow rate.

Thereafter, as with the first embodiment, the total actuator target flow rate and the total actuator flow rate are input to the first pump target displacement volume calculating section in the regulator control section for determining a differential flow rate therebetween. The subsequent control is similar to that in the first embodiment.

In the above arrangement, the control lever 41 and the pilot lines 62*a*, 62*b* make up second operation means for controlling the stroke amount of the arm directional control valve 44.

The pressure sensor 42 constitutes second operation amount detecting means for detecting the operation amount of the control lever 41.

The arm-dump target flow rate setting section in the controller 12 constitutes second target flow rate setting means for setting the arm-dump target flow rate of the arm cylinder 43 in accordance with the operation amount detected.

Further, the total actuator target flow rate calculating section in the controller 12 constitutes means for calculating the total target flow rate as given by the sum of the boom-up target flow rate and the arm-dump target flow rate.

This embodiment constructed as explained above operates as follows.

Assume now, for example, that under a light load with the bucket kept empty, the control lever 41 is operated to the right in FIG. 10 with the intention of contracting the arm cylinder 43, or the control lever 8 is operated to the left in FIG. 10 with the intention of extending the boom cylinder 3. In this case, as with the first embodiment, the delivery rate of the hydraulic pump 2 is gradually increased in accordance with the second pump target tilt angle $\theta_2$ for the conventional negative control, thereby providing a predetermined flow rate characteristic, i.e., metering characteristic.

As another example, when the control lever 41 is operated to the right in FIG. 10 and the control lever 8 is operated to the left in FIG. 10 with the intention of contracting the arm cylinder 43 and extending the boom cylinder 3 under a heavy load with the bucket hanging a burden, the boom-up target flow rate is set based on the input signals from the pump rotational speed meter 16 and the pressure sensor 11 in the boom-up target flow rate setting section of the controller 12 similarly to the first embodiment, and the arm-dump target flow rate is set based on the input signals from the pump rotational speed meter 16 and the pressure sensor 11 in the arm-dump target flow rate setting section of the controller 12, following which the total actuator target flow rate is calculated from both the target flow rates in the total actuator target flow rate calculating section. Also, as with the boom cylinder flow rate determinate section in the first embodiment, the actuator flow rate determinate section calculates the total actuator flow rate based on the input signals from the pressure sensors 9, 10, the pump tilt angle sensor 15 and the pump rotational speed meter 16. Then, the first pump target tilt angle $\theta_1$ is calculated from the total actuator target flow rate and the total actuator flow rate in the first pump target displacement volume calculating section. In the combined boom-up and arm-dump operation under a heavy load like this case, since the load pressure of each of the boom cylinder and the arm cylinder is usually large, the first pump target tilt angle $\theta_1$ is larger than the second pump target tilt angle $\theta_2$, the maximum value selecting section selects the first pump target tilt angle $\theta_1$, and the minimum value selecting section selects, as the final pump target tilt angle, the smaller one of the first pump target tilt angle $\theta_1$ and the maximum tilt angle $\theta_{max}$ obtained with the horsepower control. The drive signal generating section outputs the target current corresponding to the final pump target tilt angle to the solenoid proportional valve 13 which drives the piston 6*a* of the regulator 6 to the right in FIG. 4. As a result, the delivery rate of the hydraulic pump 2 is gradually increased so that, as with the first embodiment, the total flow rate supplied to the boom cylinder 3 and the arm cylinder 43 is increased moderately with an increase in the spool stroke of each of the boom directional control valve 1 and the arm directional control valve 44 regardless of whether the load is light or heavy, whereby a satisfactory metering characteristic is always obtained.

Also, when the control lever 41 is operated to the left in FIG. 10 for extending the arm cylinder 43 and the control lever 8 is operated to the right in FIG. 10 for contracting the boom cylinder 3, the first pump target tilt angle $\theta_1$ is zero and hence the control is always performed in accordance with the second pump target tilt angle $\theta_2$ for the above-mentioned negative control, whereby a satisfactory metering characteristic is obtained.

When the control lever 41 is operated to the left in FIG. 10 for extending the arm cylinder 43 and the control lever 8 is operated to the left in FIG. 10 for extending the boom cylinder 3, the control is performed in accordance with the larger one of the first pump target tilt angle $\theta_1$ based on the boom cylinder flow rate supplied to the boom cylinder 3 and the second pump target tilt angle $\eta_2$ for the negative control. For example, therefore, the control is performed in accordance with the first pump target tilt angle $\theta_1$ when the load pressure of the boom cylinder 3 is large, and in accordance with the second pump target tilt angle $\theta_2$ when it is small.

Further, when the control lever 41 is operated to the right in FIG. 10 for contracting the arm cylinder 43 and the control lever 8 is operated to the right in FIG. 10 for contracting the boom cylinder 3, the control is performed in accordance with the larger one of the first pump target tilt angle $\theta_1$ based on the arm cylinder flow rate supplied to the arm cylinder 43 and the second pump target tilt angle $\theta_2$ for the negative control. For example, therefore, the control is performed similarly to the above case in accordance with the first pump target tilt angle $\theta_1$ when the load pressure of the arm cylinder 43 is considerably large, and in accordance with the second pump target tilt angle $\theta_2$ when it is otherwise.

The above control modes are summarized in FIG. 12.

With this embodiment, in the combined operation of the boom cylinder 3 and the arm cylinder 43, a similar advantage to that in the first embodiment can also be provided upon application of the control in accordance with the boom cylinder flow rate or the arm cylinder flow rate. In addition, at this time, by applying the control in accordance with the boom cylinder flow rate to the boom cylinder 3 and applying the conventional negative control to the arm cylinder 3, the two control methods can be employed selectively depending on the actuators.

In the above embodiment, the maximum value selecting section selects the larger one of the first pump target tilt angle $\theta_1$ based on the actuator flow rate supplied to the boom cylinder 3 and the arm cylinder 43 and the second pump target tilt angle $\theta_2$ for the conventional negative control. However, the present invention is not limited to the above embodiment and the maximum value selecting section may be arranged to select, for example, the larger one of the first pump target tilt angle $\theta_1$ based on the boom cylinder flow rate supplied to the boom cylinder 3, the second pump target tilt angle $\theta_2$ for the conventional negative control, and a third pump target tilt angle $\theta_3$ for the so-called positive control in accordance with the operation amount of the control lever 41 associated with the arm cylinder 43. This modification will be described below with reference to FIG. 13.

Figure 13:
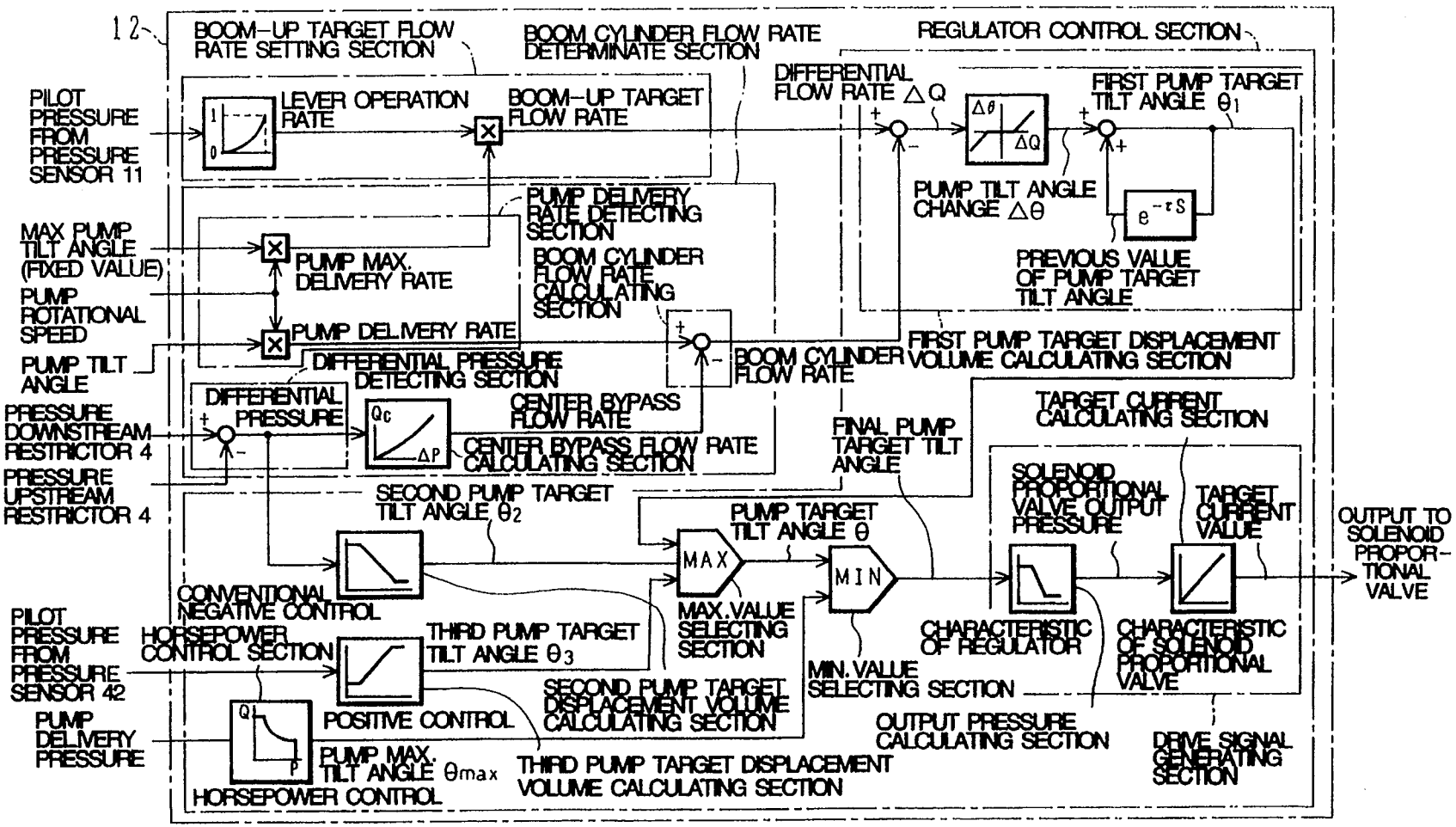
FIG. 13 is a block diagram showing control functions of a controller according to a modification of the second embodiment of the present invention.

FIG. 13 shows details of the control performed by the controller 12 in the hydraulic drive system of this modification. Note that the circuit of the hydraulic drive system for this modification is the same as in FIG. 10.

The control process shown in FIG. 13 is different from that of the first embodiment shown in FIG. 6 in that a third pump target displacement volume calculating section for calculating a third pump target tilt angle $\theta_3$ for positive control is provided in addition to the first pump target displacement volume calculating section for calculating the first pump target tilt angle $\theta_1$ and the second pump target displacement volume calculating section for calculating the second pump target tilt angle $\theta_2$, and the maximum value selecting section selects the maximum one of $\theta_1$ to $\theta_3$. The remaining part of the control is the same as in the first embodiment.

In the above arrangement, the third pump target displacement volume calculating section constitutes third target displacement volume calculating means for calculating a third target displacement volume of the hydraulic pump 2 so that the pump delivery rate depending on the operation amount of the control lever 41 detected by the pressure sensor 42 is obtained, and the maximum value selecting section constitutes means for selecting the larger one of the first and third target displacement volumes and outputting the selected one to the drive signal generating means.

This embodiment constructed as explained above operates as follows.

Assume now, for example, that under a light load with the bucket kept empty, the control lever 41 is operated to the right in FIG. 10 with the intention of contracting the arm cylinder 43, or the control lever 8 is operated to the left in FIG. 10 with the intention of extending the boom cylinder 3. In this case, as with the first and second embodiments, the delivery rate of the hydraulic pump 2 is gradually increased in accordance with the second pump target tilt angle $\theta_2$ for the conventional negative control, thereby providing a predetermined flow rate characteristic, i.e., metering characteristic.

As another example, when the control lever 41 is operated to the right in FIG. 10 and the control lever 8 is operated to the left in FIG. 10 with the intention of contracting the arm cylinder 43 and extending the boom cylinder 3 under a heavy load with the bucket hanging a burden, the boom-up target flow rate is set based on the input signals from the pump rotational speed meter 16 and the pressure sensor 11 in the boom-up target flow rate setting section of the controller 12, and the boom-up target flow rate is calculated in the boom-up target flow rate calculating section, as with the first embodiment. Also, similarly to the first embodiment, the boom cylinder flow rate determinate section calculates the boom cylinder flow rate based on the input signals from the pressure sensors 9, 10, the pump tilt angle sensor 15 and the pump rotational speed meter 16. Then, the first pump target tilt angle $\theta_1$ is calculated from the boom-up target flow rate and the boom cylinder flow rate in the first pump target displacement volume calculating section. In parallel, the third pump target tilt angle $\theta_3$ for the positive control is calculated in the third pump target displacement volume calculating section in accordance with the operation amount of the control lever 41 detected by the pressure sensor 42, and the second pump target tilt angle $\theta_2$ for the negative control is calculated in the second pump target displacement volume calculating section. In the boom-up operation and the arm-dump operation under a heavy load like this case, since the load pressure of each of the boom cylinder and the arm cylinder is usually large, the second pump target tilt angle $\theta_2$ of the above three pump target tilt angles is smaller than the other twos. Therefore, the maximum value selecting section selects the first pump target tilt angle $\theta_1$ or the second pump target tilt angle $\theta_2$. Which one of them is selected depends on the magnitude of the load pressure at that time, setting of a gain function in the positive control, and so on. But since the first pump target tilt angle $\theta_1$ is calculated through one kind of feedback control which is performed while monitoring the boom cylinder flow rate from the boom cylinder flow rate determinate section, there is a slight delay in response. At the beginning of the operation, accordingly, the third pump target tilt angle $\theta_3$ for the positive control is larger than the first pump target tilt angle $\theta_1$ and is selected by the maximum value selecting section. Then, the minimum value selecting section selects, as the final pump target tilt angle, the smaller one of the third pump target tilt angle $\theta_3$ and the maximum tilt angle $\theta_{max}$ obtained with the horsepower control. The drive signal generating section outputs the target current corresponding to the final pump target tilt angle to the solenoid proportional valve 13 which drives the piston 6a of the regulator 6 to the right in FIG. 4. As a result, the delivery rate of the hydraulic pump 2 is gradually increased so that, as with the first embodiment, the total flow rate supplied to the boom cylinder 3 and the arm cylinder 43 is increased moderately with an increase in the spool stroke of each of the boom directional control valve 1 and the arm directional control valve 44 regardless of whether the load is light or heavy, whereby a satisfactory metering characteristic is always obtained and a response at the beginning of the operation is improved.

Also, when the control lever 41 is operated to the left in FIG. 10 for extending the arm cylinder 43 and the control lever 8 is operated to the right in FIG. 10 for contracting the boom cylinder 3, the first pump target tilt angle $\theta_1$ and the third pump target tilt angle $\theta_3$ are both zero and hence the control is always performed in accordance with the second pump target tilt angle $\eta_2$ for the above-mentioned negative control, whereby a predetermined metering characteristic is obtained.

When the control lever 41 is operated to the left in FIG. 10 for extending the arm cylinder 43 and the control lever 8 is operated to the left in FIG. 10 for extending the boom cylinder 3, the third pump target tilt angle $\theta_3$ for the positive control is zero and hence the control is performed in accordance with the larger one of the first pump target tilt angle $\theta_1$ based on the boom cylinder flow rate supplied to the boom cylinder 3 and the second pump target tilt angle $\theta_2$ for the negative control. For example, therefore, the control is performed in accordance with the first pump target tilt angle $\theta_1$ when the load pressure of the boom cylinder 3 is large, and in accordance with the second pump target tilt angle $\theta_2$ when it is small.

Further, when the control lever 41 is operated to the right in FIG. 10 for contracting the arm cylinder 43 and the control lever 8 is operated to the right in FIG. 10 for contracting the boom cylinder 3, the first pump target tilt angle $\theta_1$ based on the boom cylinder flow rate is zero and hence the control is performed in accordance with the larger one of the third pump target tilt angle $\theta_3$ for the positive control supplied to the arm cylinder 43 and the second pump target tilt angle $\theta_2$ for the negative control. For example, therefore, the control is performed similarly to the above case in accordance with the third pump target tilt angle $\theta_3$ at the beginning of the operation, and in accordance with the second pump target tilt angle $\theta_2$ when it is otherwise.

The above control modes are summarized in FIG. 14.

In addition to providing a similar advantage to that in the above embodiment, this modification can also improve a response of the actuators at the beginning of the operation with combination of the control in accordance with the boom cylinder flow rate and the so-called positive control.

Third Embodiment

A third embodiment of the present invention will be described with reference to FIGS. 15 and 16. This embodiment is concerned with a hydraulic drive system for hydraulic working machines which includes means for compensating the pump delivery rate.

Figure 15:
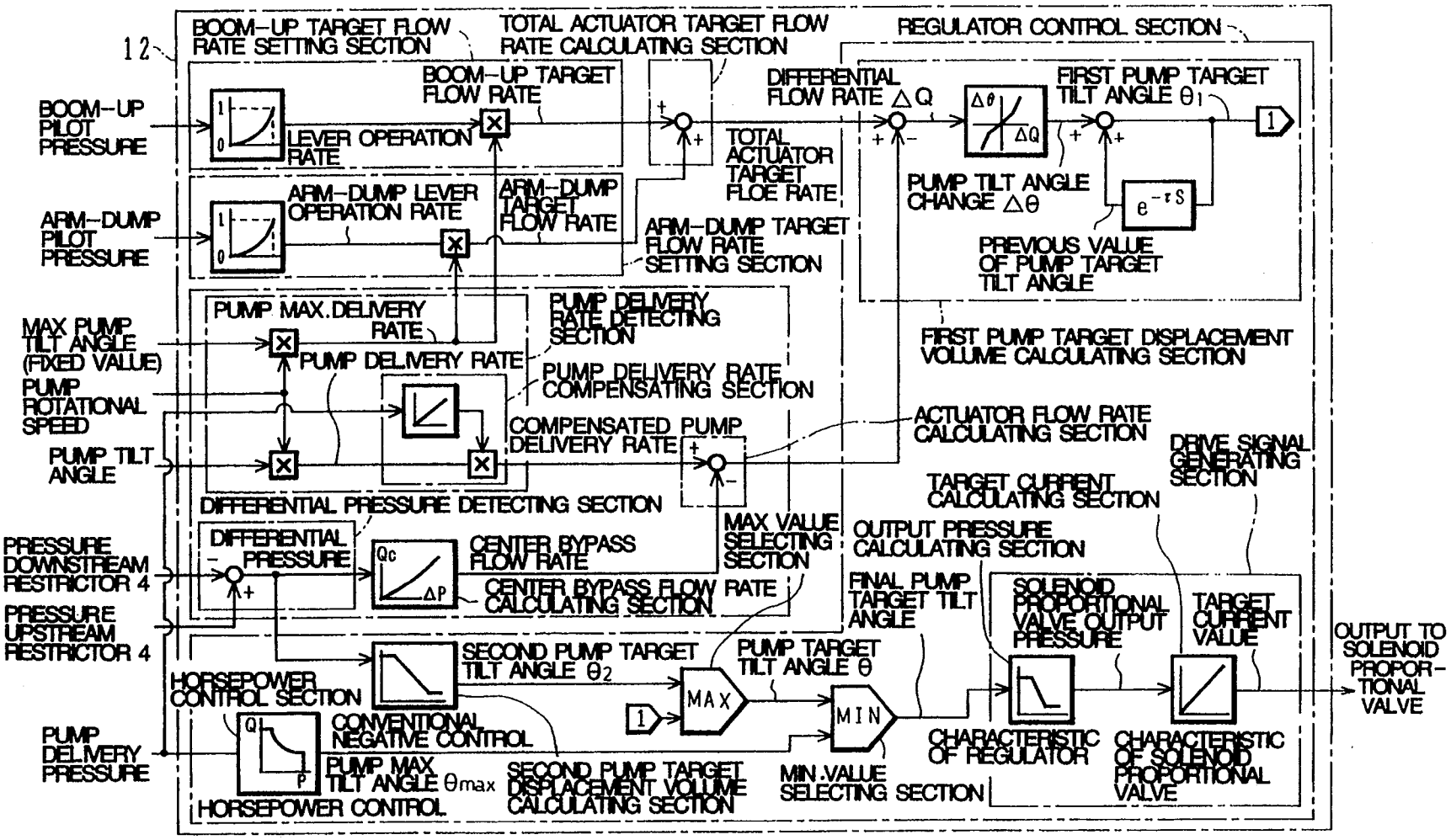
FIG. 15 is a circuit diagram of a hydraulic drive system for hydraulic working machines according to a third embodiment of the present invention.
Figure 16:
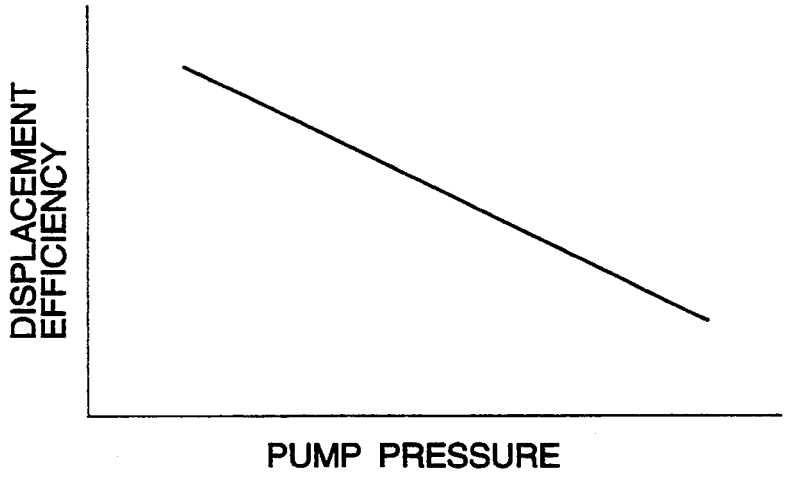
FIG. 16 is a graph showing the relationship between the pump delivery pressure and the displacement efficiency of the hydraulic pump.

FIG. 15 shows details of the control performed in a controller of the hydraulic drive system for hydraulic working machines of this embodiment. Note that the circuit of the hydraulic drive system is the same as that of the second embodiment shown in FIG. 10.

The control process shown in FIG. 15 is different from that of the second embodiment shown in FIG. 11 in that a pump delivery rate compensating section for compensating the pump delivery rate depending on the pump delivery pressure is provided in the pump delivery rate detecting section of the controller 12. The pump delivery rate compensating section modifies the pump delivery rate as follows.

Generally, the relationship between the pump delivery pressure P and the displacement efficiency of the hydraulic pump 2 is such that as the pump delivery pressure P increases, the displacement efficiency is lowered. This relationship is shown in FIG. 16.

To compensate for an effect of such a reduction in the displacement efficiency upon the pump delivery rate, the pump delivery rate compensating section receives a pump delivery pressure signal from the delivery pressure sensor 35 and sets a compensate value K determined by:

$$K=\eta P \ (\eta \text{ is a proportional constant})$$

Then, the pump delivery rate calculated from the pump rotational speed and the pump tilt angle is compensated by multiplication of the compensate value K.

Thereafter, the pump delivery flow rate thus compensated is output to the actuator flow rate calculating section.

The other arrangement and operation are the same as those in the second embodiment.

In the above arrangement, the pump delivery rate compensating section of the controller 12 constitutes compensating means for compensating the pump delivery rate depending on the delivery pressure P of the hydraulic pump 2. For example, when the pump delivery pressure P is large, the compensation gives the larger pump delivery rate based on which the regulator 6 is controlled in its operation.

In addition to providing he advantage in the second embodiment, this embodiment can eliminate the effect of a reduction in the displacement efficiency of the hydraulic pump 2 as a result of compensating the pump delivery rate using the compensate value K. Consequently, the total actuator flow rate which is a total of the flow rates actually supplied to the boom cylinder 3 and the arm cylinder 43 can be determined with higher accuracy.

Fourth Embodiment

A fourth embodiment of the present invention will be described with reference to FIGS. 17 and 18. This embodiment is concerned with a hydraulic drive system for hydraulic working machines in which electric levers are used as the control levers.

Figure 17:
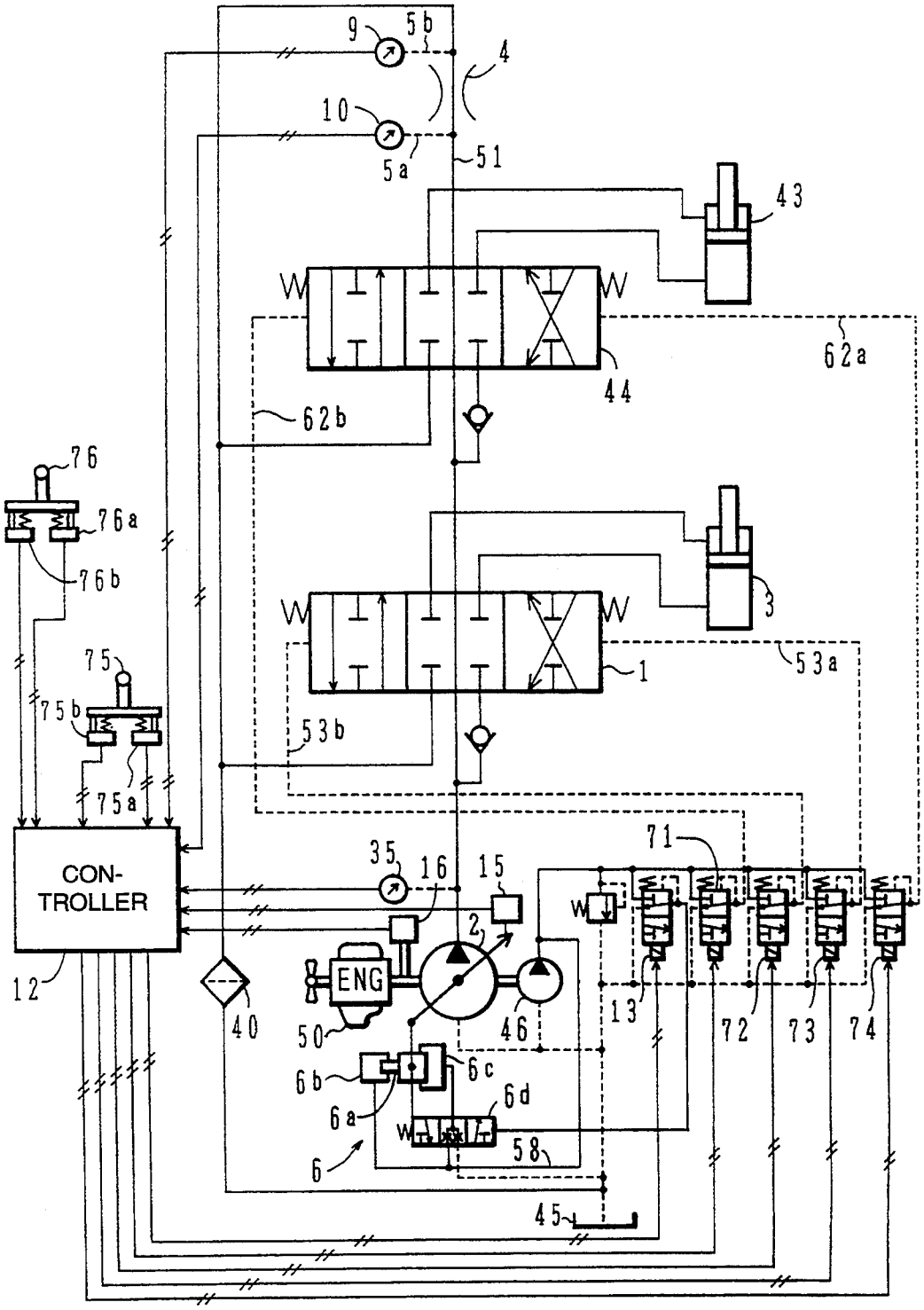
FIG. 17 is a circuit diagram of a hydraulic drive system for hydraulic working machines according to a fourth embodiment of the present invention.

FIG. 17 shows a circuit diagram of the hydraulic drive system for hydraulic working machines of this embodiment. In FIG. 17, identical members to those in the first to third embodiments are denoted by the same reference numerals.

Referring to FIG. 17, the hydraulic drive system of this embodiment is different from that of the second embodiment in that the operation means for the boom directional control valve 1 and the arm directional control valve 44 comprise respectively electric levers 75, 76, stroke sensors 75*a, b* and 76*a, b* for detecting shift amounts through which the electric levers 75, 76 are operated, and solenoid proportional valves 71 to 74 for receiving signals which are output from the controller 12 depending on the shift amounts detected by the stroke sensors 75*a, b* and 76*a, b*. The other arrangement is substantially the same as in the second embodiment.

Figure 18:
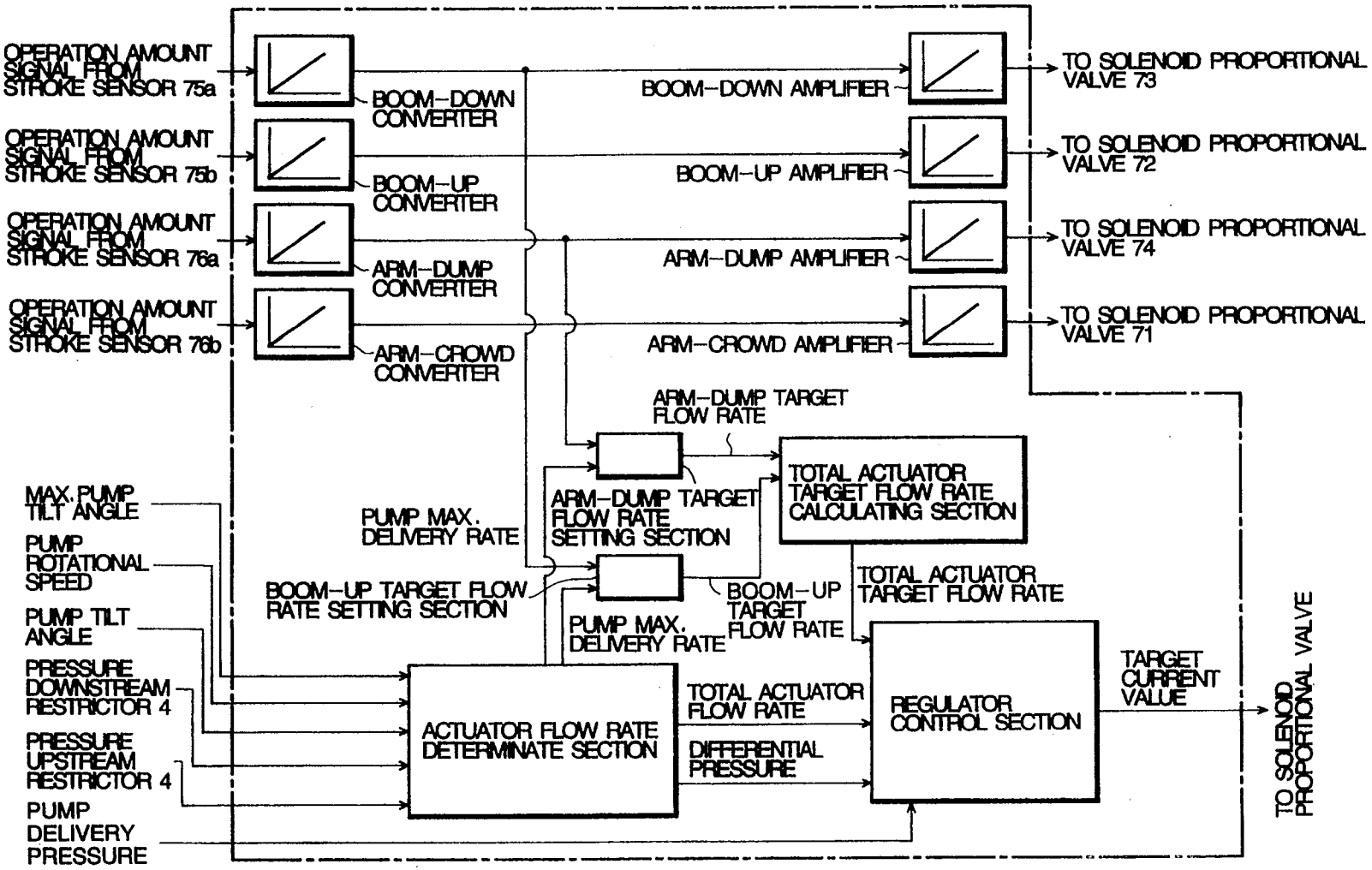
FIG. 18 is a block diagram showing control functions of a controller shown in FIG. 17.

FIG. 18 shows details of the control performed in the controller 12.

The control process shown in FIG. 18 is different from that of the second embodiment shown in FIG. 11 in that, corresponding to the above differences in the arrangement, the controller 12 includes a boom-down converter, a boom-up converter, an arm-dump converter and an arm-crowd converter for respectively receiving the operation amount signals from the stroke sensors 75*a*, 75*b*, 76*a* and 76*b* for conversion into electric signals in the controller, and a boom-down amplifier, a boom-up amplifier, an arm-dump amplifier and an arm-crowd amplifier for respectively amplifying the electric signals converted by those converters and outputting amplified signals to the corresponding solenoid proportional valves 71 to 74, the signals from the boom-up converter and the arm-dump converter being input respectively to the boom-up target flow rate setting section and the arm-dump target flow rate setting section. The other control process is the same as in the second embodiment.

In the above arrangement, the electric lever 75, the stroke sensors 75*a*, 75*b*, the boom-up converter, the boom-down converter, the boom-up amplifier and the boom-down amplifier in the controller 12, the solenoid proportional valves 72, 73, and the pilot lines 53*a*, 53*b* make up first operation means for controlling the stroke amount of the boom directional control valve 1, whereas the electric lever 76, the stroke sensors 76*a*, 76*b*, the arm-dump converter, the arm-crowd converter, the arm-dump amplifier and the arm-crowd amplifier in the controller 12, the solenoid proportional valves 71, 74, and the pilot lines 62*a*, 62*b* make up second operation means for controlling the stroke amount of the arm directional control valve 44.

The stroke sensors 75*a*, *b* constitute first operation amount detecting means for detecting the operation amount through which the electric lever 75 is operated, and the stroke sensors 76*a*, *b* constitute second operation amount detecting means for detecting the operation amount through which the electric lever 76 is operated.

Further, the regulator control section in the controller 12 and the solenoid proportional valve 13 constitutes regulator control means for controlling the drive of the regulator so that the total actuator flow rate as given by the sum of the boom cylinder flow rate and the arm cylinder flow rate comes closer to the total actuator target flow rate as given by the sum of the boom-up target flow rate and the arm-dump target flow rate.

This embodiment constructed as explained above operates as follows.

For example, when the electric lever 76 is operated to the right in FIG. 17 with the intention of contracting the arm cylinder 43 (i.e., effecting the arm-dump operation), the operation amount of the electric lever 76 is detected by the stroke sensor 76*a* and is input to the arm-dump converter in the controller 12. After the conversion into electric signals, the operation amount is transmitted to the arm-dump amplifier which outputs a corresponding drive signal to the solenoid proportional valve 74. Then, the hydraulic fluid supplied from the auxiliary hydraulic pump 46 is applied, as a pilot pressure, to a driving sector positioned on the right side of the arm directional control valve 44 in the drawing through the solenoid proportional valve 74 and the pilot line 62*a*. As a result, the arm directional control valve 44 is gradually moved through its stroke to a right shift position in FIG. 17 (i.e., to the left) and the arm cylinder 43 is operated in the direction to contract.

On the contrary, when the electric lever 76 is operated to the left in FIG. 17 with the intention of extending the arm cylinder 43 (i.e., effecting the arm-crowd operation), the operation amount of the electric lever 76 is detected by the stroke sensor 76*b* and is input to the arm-crowd converter in the controller 12. After the conversion into electric signals, the operation amount is transmitted to the arm-crowd amplifier which outputs a corresponding drive signal to the solenoid proportional valve 71. Then, the hydraulic fluid supplied from the auxiliary hydraulic pump 46 is applied, as a pilot pressure, to a driving sector positioned on the left side of the arm directional control valve 44 in the drawing through the solenoid proportional valve 71 and the pilot line 62*b*. As a result, the arm directional control valve 44 is gradually moved through its stroke to a left shift position in FIG. 17 (i.e., to the right) and the arm cylinder 43 is operated in the direction to extend.

The above operation equally applies to the case where the electric lever 75 is operated to the right (or left) in FIG. 17 for moving the boom directional control valve 1 through its stroke to a right (or left) shift position, to thereby operate the boom cylinder 3 in the direction to extend (or contract).

The operation, including the control process, other than the manipulation of the electric levers and the detection of their shift amounts is the same as in the second embodiment.

This embodiment can also provide a similar advantage to that in the second embodiment.

INDUSTRIAL APPLICABILITY

According to the present invention, since the actuator flow rate is in itself controlled, the metering characteristic is not affected by variations in the load pressure and a satisfactory metering characteristic can always be obtained regardless of whether the load is light or heavy. Therefore, an operator can operate a hydraulic working machine with no need of paying considerable care as to whether the load is large or small, and the working efficiency can be increased as compared with the prior art, while making the operator feel less fatigued.

We claim:

1. A hydraulic drive system for hydraulic working machines comprising a variable displacement hydraulic pump (2), a first actuator (3) driven by a hydraulic fluid delivered from said hydraulic pump (2), a first directional control valve (1) of center bypass type having meter-in passages ($b_1$, $b_2$) provided with meter-in variable restrictors (55*a*, 55*b*) and a center bypass passage (1*a*) provided with bleed-off variable restrictors (54*a*, 54*b*) for controlling a flow of the hydraulic fluid supplied from said hydraulic pump (2) to said first actuator (3), first operation means (8; 75, 75*a*, 75*b*, 12, 72, 73; 53*a*, 53*b*) for controlling a stroke amount of said first directional control valve (1), a low pressure circuit (45), a center bypass line (51) for connecting said center bypass passage (1*a*) to said low pressure circuit (45) at a point downstream of said bleed-off variable restrictors (54*a*, 54*b*), and a regulator (6) for controlling a displacement volume of said hydraulic pump (2), wherein:

said hydraulic drive system further comprises first operation amount detecting means (11; 75*a*, 75*b*) for detecting a operation amount of said first operation means (8; 75, 75*a*, 75*b*, 12, 72, 73; 53*a*, 53*b*);

first target flow rate setting means (12) for setting a first target flow rate of said first actuator (3) in accordance with said operation amount detected;

flow rate determinate means (15, 16; 4, 9, 10, 5*a*, 5*b*; 12) for determining an actual actuator flow rate supplied to said first actuator (3); and regulator control means (12, 13) for controlling the drive of said regulator (6) so that said actual actuator flow rate comes closer to said first target flow rate.

2. A hydraulic drive system for hydraulic working machines according to claim 1, wherein said regulator control means comprises first target displacement volume calculating means (12) for calculating a first target displacement volume of said hydraulic pump (2) so as to provide a pump delivery rate at which said actuator flow rate comes closer to said first target flow rate, and drive signal generating means (12, 13) for generating a drive signal for said regulator (6) in accordance with said first target displacement volume.

3. A hydraulic drive system for hydraulic working machines according to claim 1, wherein said flow rate determinate means comprises first flow rate detecting means (4; 9, 10, 5*a*, 5*b*, 12) for detecting a first flow rate passing through said center bypass passage (1*a*), second flow rate detecting means (15, 16, 12) for detecting a second flow rate delivered from said hydraulic pump (2), and means (12) for calculating, as said actuator flow rate, the difference between said first flow rate and said second flow rate.

4. A hydraulic drive system for hydraulic working machines according to claim 3, wherein said first flow rate detecting means comprises pressure generating means (4) disposed in said center bypass line (51), differential pressure detecting means (9, 10, 5*a*, 5*b*, 12) for detecting a differential pressure across said pressure generating means (4), and means (12) for calculating said first flow rate in accordance with said differential pressure detected.

5. A hydraulic drive system for hydraulic working machines according to claim 1, wherein said regulator control means (12, 13) includes means for controlling the drive of said regulator so that said actuator flow rate becomes equal to said first target flow rate.

6. A hydraulic drive system for hydraulic working machines according to claim 2, further comprising pressure generating means (4) disposed in said center bypass line (51), pressure detecting means (5*a*, 10, 12) for detecting a pressure generated by said pressure generating means (4), second target displacement volume calculating means (12) for calculating a second target displacement volume of said hydraulic pump (2) so as to provide a pump delivery rate depending on said detected pressure, and means (12) for selecting the larger one of said first and second target displacement volumes and outputting the selected one to said drive signal generating means (12, 13), wherein said drive signal generating means (12, 13) includes means for generating a drive signal for said regulator (6) in accordance with said selected target displacement volume.

7. A hydraulic drive system for hydraulic working machines according to claim 6, wherein said first operation means includes means (8, 53*b*; 75, 75*b*, 12, 72, 53*b*) for outputting a first signal to move said first directional control valve (1) in one direction from the neutral position and a second signal to move said first directional control valve in the other direction from the neutral position, and said first operation amount detecting means includes means (11; 75*b*) for detecting the operation amount as given by said first signal.

8. A hydraulic drive system for hydraulic working machines according to claim 6, further comprising a second actuator (43) and a second directional control valve (44) of center bypass type having meter-in passages provided with meter-in variable restrictors and a center bypass passage provided with bleed-off variable restrictors for controlling a flow of the hydraulic fluid supplied from said hydraulic pump (2) to said second actuator (43).

9. A hydraulic drive system for hydraulic working machines according to claim 1, further comprising a second actuator (43), a second directional control valve (44) of center bypass type having meter-in passages provided with meter-in variable restrictors and a center bypass passage provided with bleed-off variable restrictors for controlling a flow of the hydraulic fluid supplied from said hydraulic pump (2) to said second actuator (43), second operation means (41; 76, 76*a*, 76*b*, 12, 71, 74; 62*a*, 62*b*) for controlling a stroke amount of said second directional control valve (44), second operation amount detecting means (42; 76*a*, 76*b*) for detecting a operation amount of said second operation means (41; 76, 76*a*, 76*b*, 12, 71, 74; 62*a*, 62*b*), second target flow rate setting means (12) for setting a second target flow rate of said second actuator (43) in accordance with said operation amount detected, and means (12) for determining a total target flow rate as given by the sum of said first target flow rate and said second target flow rate, wherein said flow rate determinate means (15, 16; 4, 9, 10, 5*a*, 5*b*; 12) includes means for determining a total actuator flow rate as given by the sum of actual actuator flow rates supplied to said first and second actuators (3; 43), and said regulator control means (12, 13) includes means for controlling the drive of said regulator (6) so that said total actuator flow rate comes closer to said total target flow rate.

10. A hydraulic drive system for hydraulic working machines according to claim 2, further comprising third target displacement volume calculating means (12) for calculating a third target displacement volume of said hydraulic pump (2) so as to provide a pump delivery rate depending on said operation amount detected by said first operation amount detecting means (11; 75*a*, 75*b*), and means (12) for selecting the larger one of said first and third target displacement volumes and outputting the selected one to said drive signal generating means (12, 13), wherein said drive signal generating means (12, 13) includes means for generating a drive signal for said regulator (6) in accordance with said selected target displacement volume.

11. A hydraulic drive system for hydraulic working machines according to claim 3, further comprising delivery pressure detecting means (35) for detecting a delivery pressure of said hydraulic pump (2), and compensating means (12) for compensating said second flow rate depending on said delivery pressure detected.

12. A hydraulic drive system for hydraulic working machines according to claim 2, further comprising a prime mover (50) for driving said hydraulic pump (2), fourth target displacement volume calculating means (12) for calculating a fourth target displacement volume of said hydraulic pump (2) so as to limit an input torque of said hydraulic pump (2) to be not greater-than an output torque of said prime mover (50), and means (12) for selecting the smaller one of said first and fourth target displacement volumes and outputting the selected one to said drive signal generating means (12, 13), wherein said drive signal generating means (12, 13) includes means for generating a drive signal for said regulator (6) in accordance with said selected target displacement volume.

* * * * *